US009502010B1

(12) United States Patent
Cardozo

(10) Patent No.: US 9,502,010 B1
(45) Date of Patent: Nov. 22, 2016

(54) GUITAR TREMOLO BRIDGE

(71) Applicant: William Cardozo, Ketchum, ID (US)

(72) Inventor: William Cardozo, Ketchum, ID (US)

( * ) Notice: Subject to any disclaimer, the term of this patent is extended or adjusted under 35 U.S.C. 154(b) by 0 days.

(21) Appl. No.: 14/808,279

(22) Filed: Jul. 24, 2015

Related U.S. Application Data

(60) Provisional application No. 62/114,378, filed on Feb. 10, 2015, provisional application No. 62/078,295, filed on Nov. 11, 2014, provisional application No. 62/040,609, filed on Aug. 22, 2014.

(51) Int. Cl.
*G10D 3/14* (2006.01)

(52) U.S. Cl.
CPC ..... *G10D 3/146* (2013.01)

(58) Field of Classification Search
CPC ..... G10D 3/146
See application file for complete search history.

(56) References Cited

U.S. PATENT DOCUMENTS

| | | | | |
|---|---|---|---|---|
| 2,741,146 | A | 4/1956 | Fender | |
| 2,781,685 | A | 2/1957 | White et al. | |
| 2,897,709 | A | 8/1959 | McCarty et al. | |
| 2,960,900 | A | 11/1960 | Fender | |
| 2,972,923 | A | 2/1961 | Fender | |
| 3,237,502 | A | 3/1966 | Moseley | |
| 3,241,418 | A | 3/1966 | Fender | |
| 3,248,991 | A | 5/1966 | Cole | |
| 3,382,749 | A | 5/1968 | Watson | |
| 3,411,394 | A | 11/1968 | Jones | |
| 3,424,049 | A | 1/1969 | Daniel | |
| 3,479,917 | A | 11/1969 | Zitnik, Jr. et al. | |
| 4,171,661 | A | 10/1979 | Rose | |
| 4,341,144 | A | 7/1982 | Milne | |
| 4,383,466 | A | 5/1983 | Shibuya | |
| 4,453,443 | A | 6/1984 | Smith | |
| 4,475,432 | A | 10/1984 | Stroh | |
| 4,497,236 | A | 2/1985 | Rose | |
| 4,555,970 | A | 12/1985 | Rose | |
| 4,572,049 | A | 2/1986 | Tanaka et al. | |
| 4,611,523 | A | 9/1986 | McFarland | |
| 4,648,304 | A | 3/1987 | Hoshino et al. | |
| 4,655,116 | A | 4/1987 | Matsui | |
| 4,656,916 | A | 4/1987 | Gressett, Jr. | |
| 4,672,877 | A | 6/1987 | Hoshino et al. | |
| 4,677,891 | A | 7/1987 | Gressett, Jr. et al. | |
| 4,697,493 | A * | 10/1987 | Ralston | G10D 3/146 84/313 |
| 4,869,145 | A | 9/1989 | Evans | |

(Continued)

FOREIGN PATENT DOCUMENTS

| | | |
|---|---|---|
| CA | 2676726 A1 | 3/2011 |
| CA | 2811930 A1 | 3/2011 |

(Continued)

*Primary Examiner* — Robert W Horn
(74) *Attorney, Agent, or Firm* — Buchanan Nipper

(57) ABSTRACT

A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising: a base plate, a block extending from said base plate, a tremolo arm attached to said base plate, and a locking mechanism for locking the position of the tremolo bridge.

20 Claims, 17 Drawing Sheets

(56) References Cited

U.S. PATENT DOCUMENTS

| | | | | | |
|---|---|---|---|---|---|
| 4,892,025 | A * | 1/1990 | Steinberger | G10D 3/146 | 84/313 |
| 4,903,568 | A | 2/1990 | Itoh | | |
| 4,932,302 | A | 6/1990 | Saijo | | |
| 4,939,971 | A | 7/1990 | Satoh | | |
| 5,046,393 | A | 9/1991 | Xenidis | | |
| 5,088,374 | A | 2/1992 | Saijo | | |
| 5,088,375 | A | 2/1992 | Saijo | | |
| 5,140,884 | A | 8/1992 | Bowden | | |
| 5,196,641 | A | 3/1993 | Schaller | | |
| 5,198,601 | A | 3/1993 | McCabe | | |
| 5,260,511 | A | 11/1993 | Gregory | | |
| 5,277,094 | A | 1/1994 | Spuler | | |
| 5,305,675 | A | 4/1994 | Lasner | | |
| 5,311,804 | A * | 5/1994 | Wilkinson | G10D 3/143 | 84/313 |
| 5,373,769 | A | 12/1994 | Sherman | | |
| 5,381,716 | A | 1/1995 | May et al. | | |
| 5,413,019 | A | 5/1995 | Blanda, Jr. | | |
| 5,419,227 | A | 5/1995 | Lavineway | | |
| 5,481,955 | A | 1/1996 | Goto | | |
| 5,522,297 | A * | 6/1996 | Enserink | G10D 3/146 | 84/313 |
| 5,522,298 | A | 6/1996 | Schaller et al. | | |
| 5,539,144 | A | 7/1996 | Sherman | | |
| 5,708,225 | A | 1/1998 | Sherman | | |
| 5,747,713 | A | 5/1998 | Clement | | |
| 5,783,763 | A | 7/1998 | Schaller et al. | | |
| 5,824,925 | A | 10/1998 | Yost | | |
| 5,942,703 | A | 8/1999 | Boehnlein et al. | | |
| 5,965,831 | A | 10/1999 | McCabe | | |
| 5,986,190 | A | 11/1999 | Wolff et al. | | |
| 5,986,192 | A * | 11/1999 | Wingfield | G10D 3/146 | 84/313 |
| 6,015,945 | A | 1/2000 | Borisoff | | |
| 6,100,459 | A | 8/2000 | Yost | | |
| 6,384,311 | B1 | 5/2002 | Cota | | |
| 6,552,252 | B2 | 4/2003 | Hirayama | | |
| 6,573,439 | B2 | 6/2003 | Wilson | | |
| 6,703,546 | B1 | 3/2004 | Wilson | | |
| 6,812,389 | B2 * | 11/2004 | Trooien | G10D 3/146 | 84/312 R |
| 6,943,284 | B2 | 9/2005 | Didan | | |
| 7,145,065 | B2 | 12/2006 | Geier | | |
| 7,259,309 | B1 | 8/2007 | Lovelace | | |
| 7,329,808 | B2 | 2/2008 | Davis | | |
| 7,339,102 | B2 | 3/2008 | Folmar et al. | | |
| 7,427,703 | B2 * | 9/2008 | Geier | G10D 3/146 | 84/307 |
| 7,446,248 | B2 | 11/2008 | Skinn | | |
| 7,531,731 | B2 | 5/2009 | Longo | | |
| 7,541,528 | B2 | 6/2009 | Lyles | | |
| 7,557,282 | B2 | 7/2009 | Holdway | | |
| 7,592,528 | B2 | 9/2009 | Lyles | | |
| 7,663,038 | B2 | 2/2010 | Stadler | | |
| 7,692,079 | B2 | 4/2010 | Lyles | | |
| 7,745,709 | B2 | 6/2010 | Benjamin | | |
| 7,842,869 | B2 | 11/2010 | Adams | | |
| 7,855,330 | B2 | 12/2010 | Lyles | | |
| 7,888,570 | B2 | 2/2011 | Lyles | | |
| 7,888,571 | B2 * | 2/2011 | Steinberger | G10D 3/146 | 84/267 |
| 8,017,844 | B2 * | 9/2011 | Steinberger | G10D 3/146 | 84/298 |
| 8,252,999 | B2 | 8/2012 | Deck | | |
| 8,344,231 | B2 | 1/2013 | Hamilton | | |
| 8,536,430 | B2 | 9/2013 | McCabe | | |
| 8,536,431 | B1 | 9/2013 | McCabe | | |
| 9,029,671 | B1 * | 5/2015 | Smith | G10D 3/146 | 84/313 |
| 9,330,639 | B1 * | 5/2016 | Armstrong | G10D 3/146 | |
| 2006/0005687 | A1 * | 1/2006 | Minakuchi | G10D 3/146 | 84/313 |
| 2008/0072735 | A1 * | 3/2008 | Kahler | G10D 3/146 | 84/313 |
| 2011/0036228 | A1 | 2/2011 | Deck | | |
| 2011/0072952 | A1 | 3/2011 | Koyama | | |
| 2013/0047816 | A1 | 2/2013 | Rukavina | | |
| 2013/0291705 | A1 | 11/2013 | Rose | | |

FOREIGN PATENT DOCUMENTS

| | | | |
|---|---|---|---|
| DE | 4036956 | A1 | 9/1991 |
| DE | 4209573 | A1 | 11/1992 |
| WO | 9527280 | A1 | 10/1995 |
| WO | 9705600 | A1 | 2/1997 |
| WO | 2013006976 | A1 | 1/2013 |

* cited by examiner

GUITAR TREMOLO BRIDGE

TECHNICAL FIELD

The disclosure generally relates to the field of stringed musical instruments. Particular embodiments relate to electric guitars.

BACKGROUND

Traditionally, guitars have a headstock opposite a tail. The head includes a headpiece having tuning pegs to which the first ends of the guitar strings attach. The strings extend along a fretboard to the body of the guitar where, at their second ends, they mount to a bridge which, typically, extends generally perpendicular to the length of the strings. In such a configuration, the bridge has a front side which is nearer to the head of the guitar, and a rear side which is nearer to the tail of the guitar. In such a guitar, the bridge is rigidly mounted to the body of the guitar.

In roughly 1954, Fender Guitar Corp. patented a new design for a guitar bridge used with an electric guitar, a design commonly referred to as a "fulcrum-style tremolo bridge." A fulcrum-style tremolo bridge allows a guitar player to raise and lower the pitch of the strings by pulling up on, or pushing down on, a tremolo arm that is attached to the bridge. In a fulcrum-style tremolo bridge, a first side of the bridge is held in tension against the body of the guitar, wherein the bridge can pivot at its contact point with the body. In one such type fulcrum-style tremolo bridge, referred to as a Wilkenson bridge, the front side of the bridge has a blade edge which is held in tension against a pair of posts mounted to the body of the guitar, and the bridge is able to pivot at the connection between the blade edge and the posts (described infra). In another fulcrum-style tremolo bridge, the tremolo bridge pivots based on a number of fasteners (e.g., screws) which extend through the front portion of the tremolo bridge and into the body.

The embodiments discussed herein are discussed relative to such a Wilkenson bridge. For instance, using language like "at least one post extending from said body, each of said at least one post further comprising a V-shaped notch." However, such language is intended to include other such floating bridges, including the original fender "six hole" fulcrum bridge wherein the bridge attaches loosely to the body of the guitar using screws, and it is the contact with the screws that serves as the pivotal connection that is the equivalent to the edge pivoting in the V-shaped notch of a post described herein.

In a fulcrum-style tremolo bridge, in general, the rear side of the bridge "floats" and is not mounted to the body of the guitar. The bridge further includes a block attached to the bottom of the bridge which passes through the guitar. Attached to this block are springs that run forward from the block toward the neck of the guitar. The springs counterbalance the tension of the strings of the guitar, holding the strings of the guitar in tune in a default position where the tension of the strings on the bridge is generally equal to the tension of the springs on the bridge. In such a configuration, the bridge can pivot upwards and downwards generally around an axis that is defined by the point where the blade edge of the bridge contacts the posts of the body.

When the guitar is in tune, the bridge lies somewhere between the limits of the distance that it can pivot. When the rear side of the bridge pivots upwards (away from the body of the guitar), the pitch of the strings is lowered; whereas when the rear side of the bridge pivots downwards (towards the body of the guitar), the pitch of the strings is raised.

A traditional fulcrum-style tremolo bridge has a commonly known limitation that occurs when the guitar player bends a string to raise its pitch. When one string is bent, the tension generated by bending the string overcomes the opposing tension from the springs, and the rear side of the bridge will pivot upwards (away from the body of the guitar). This pivoting motion may result in the pitch of all of the strings changing (not just the string bent). Further, this pivoting motion may result in the pitch of the strings changing unequally. For instance, when the bridge is pivoted all of the guitar's strings change equally in length but change unequally in pitch. This occurs due to the difference in each string's diameter. Thus, even a relatively small pivoting motion results in a pitch change across multiple strings. Because of this, a problem exists for a guitarist who may want to play other notes or chords on the other strings while the bent string is bent.

SUMMARY OF THE DISCLOSURE

Several exemplary guitar tremolo bridges are described herein.

A first exemplary tremolo bridge comprises a tremolo arm and locking mechanism. The tremolo arm is capable of being rotated into a locked position and an unlocked position. When in the locked position, the locking mechanism fixes the guitar's bridge in its then-current position relative to the guitar. Conversely, when the tremolo arm is rotated into an unlocked position, the guitar's bridge can tilt freely.

Optionally, the locking mechanism further comprises a pressure pin and body plate. The body plate is fixed to the guitar's body and the pressure pin is operably attached to the tremolo arm by a cam member and boss. When the tremolo arm is rotated into its locked position, the cam member engages the boss, thus extending the pressure pin along an axis and making contact with the body plate. When this contact is made, the guitar's bridge is fixed in its then-current position.

The locking mechanism further comprises a biasing portion for biasing the pressure pin in an opposite direction. In this configuration, when the tremolo arm is rotated into its unlocked position, the pressure pin retracts along the same axis and disengages the body plate. Thus, the guitar's bridge can tilt freely.

A second exemplary tremolo bridge comprises a tremolo arm, a sensor, an electronic actuator and a locking system, further comprised of a brake rod and brake portion; the brake rod extends through the brake portion. The tremolo arm is capable of being rotated into a locked and an unlocked position, which triggers the sensor. When in the locked position, the sensor electronically signals the electronic actuator. Upon being signaled, the actuator engages the locking system. When engaged, the brake portion engages the brake rod thus fixing the guitar's bridge in its then-current position. Conversely, rotation of the tremolo arm in a second direction disengages the locking system, allowing for the guitar's bridge to tilt freely.

Optionally, the locking mechanism can be triggered by a switch that is part of a replacement potentiometer which replaced one of the existing potentiometers (e.g., volume, tone) on the guitar.

Optionally, the brake can be activated by a servo, solenoid, or other electro-mechanical mechanism.

A third exemplary guitar tremolo bridge comprises a tremolo arm and locking system, further comprised of a brake rod and brake system; the brake rod extends through the brake portion. The tremolo arm is capable of being rotated into a locked and an unlocked position, which locks the bridge in its then-current position. The tremolo arm is operatively connected to the locking mechanism such that when the arm is rotated into its locked position, the brake system engages the brake rod. In such a configuration, the guitar's bridge is held in its then-current position. Conversely, rotation of the tremolo arm in a second direction disengages the locking system, allowing for the guitar's bridge to tilt freely.

Optionally, the locking mechanism comprises a brake portion, sensor, and electronic actuator. The brake portion configured so that a brake rod is attached to the guitar's bridge and runs through a brake. When the tremolo arm is rotated into its locked position the sensor notifies the electronic actuator, via an electronic signal. When the electronic actuator is notified it engages the brake, thus clamping down on the brake rod. In this position, the guitar's bridge is fixed in its then-current position.

When the tremolo arm is rotated into its unlocked position, the sensor notifies the electronic actuator, via an electronic signal and the brake is disengaged. In this position, the guitar's bridge can tilt freely.

A third exemplary tremolo bridge comprises a tremolo arm, tremolo axle, and locking mechanism. The tremolo arm is operably attached to the tremolo axle and is rotatable between a locked and an unlocked position. When the tremolo arm is rotated into its locked position, the tremolo axle engages the locking mechanism, further comprised of a pressure pin and body plate. The body plate is fixed to the guitar's body and the pressure pin is operably attached to the tremolo axle by a cam member and boss. When the tremolo arm is rotated into its locked position, the tremolo axle enables the cam member to engage the boss, thus extending the pressure pin along an axis and making contact with the body plate. When this contact is made, the guitar's bridge is fixed in its then-current position.

The locking mechanism further comprises a biasing portion for biasing the pressure pin in an opposite direction. In this configuration, when the tremolo arm is rotated into its unlocked position, the tremolo axle retracts the pressure pin along the same axis and disengages the body plate. Thus, the guitar's bridge can tilt freely.

A fourth exemplary tremolo bridge comprises a tremolo arm, sensor, electronic actuator, and locking system. The tremolo arm is capable of being rotated into a locked and an unlocked position. When in the locked position, the locking mechanism fixes the guitar's bridge in its then-current position relative to the guitar. Conversely, when the tremolo arm is rotated into an unlocked position, the guitar's bridge can tilt freely.

The locking mechanism further comprises a brake portion, sensor, and electronic actuator. The brake portion configured so that a brake rod is attached to the guitar's bridge and runs through a brake. When the tremolo arm is rotated into its locked position the sensor notifies the electronic actuator, via an electronic signal. When the electronic actuator is notified it engages the brake, thus clamping down on the brake rod. In this position, the guitar's bridge is fixed in its then-current position.

When the tremolo arm is rotated into its unlocked position, the sensor notifies the electronic actuator, via an electronic signal and the brake is disengaged. In this position, the guitar's bridge can tilt freely.

Additional understanding of the devices and methods contemplated and/or claimed by the inventor(s) can be gained by reviewing the detailed description of exemplary devices and methods, presented below, and the referenced drawings.

DETAILED DESCRIPTION

Figure 1:
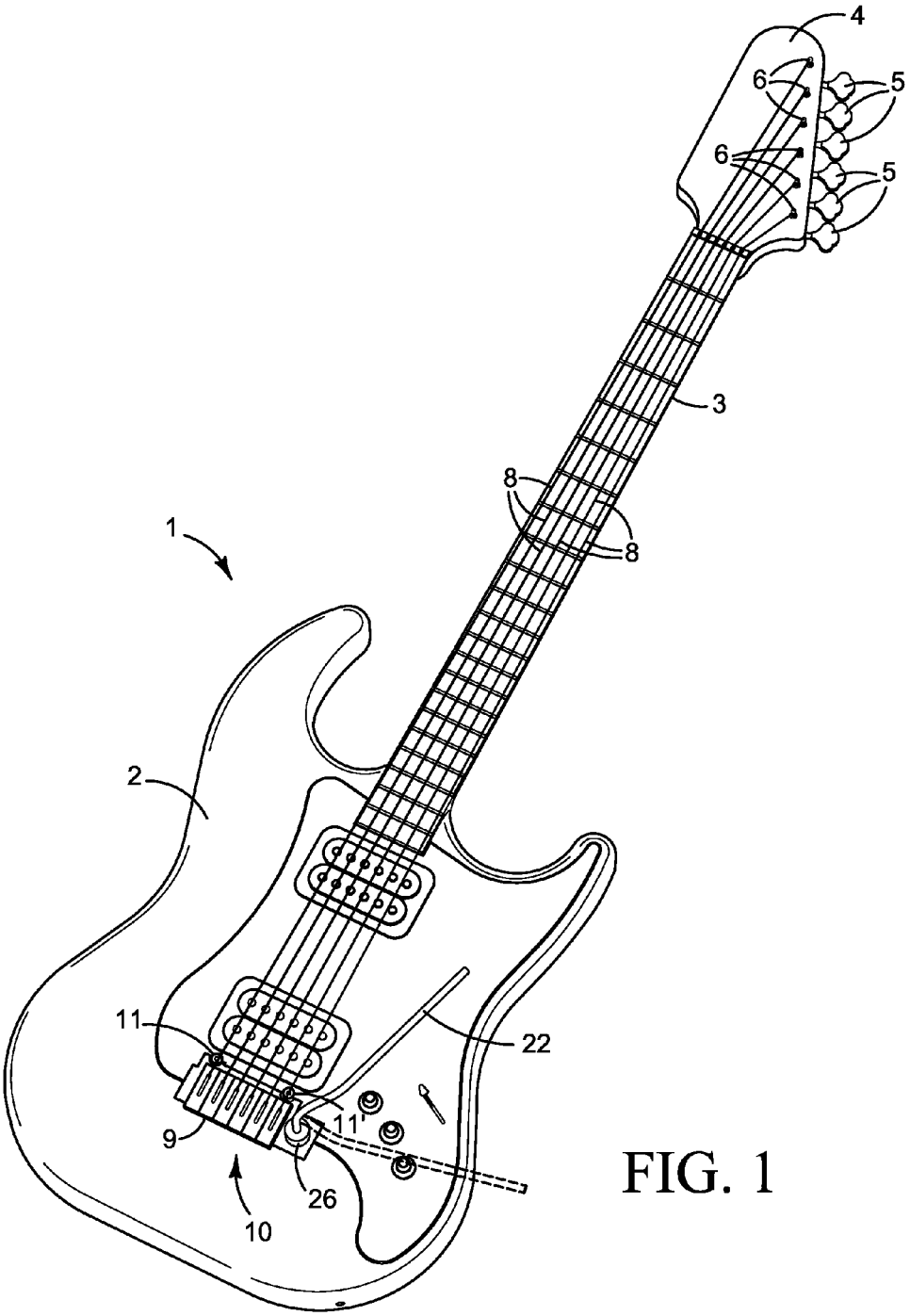
FIG. 1 is a top perspective view of a guitar having a first exemplary guitar tremolo bridge.
Figure 2:
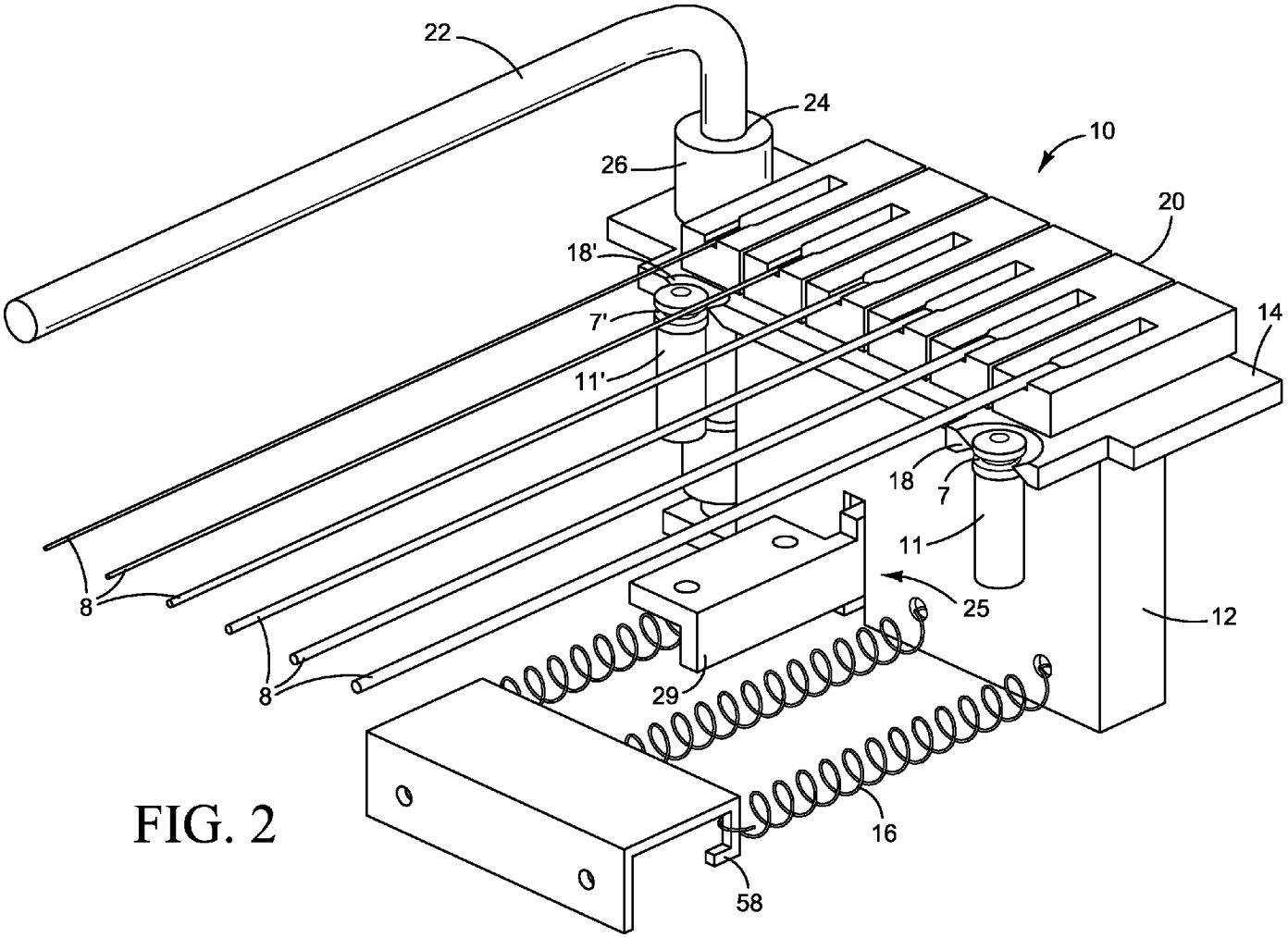
FIG. 2 is a partial, first side top perspective view of the first exemplary guitar tremolo bridge.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a pressure pin" includes two or more such pressure pins, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment.

The use of "sensor" means any device that performs a measurement of its environment and transmits a signal regarding that measurement, including but not limited to, optical sensors (e.g., optical detectors, optical eyes (e.g., CCD or LED sensor/receiver combinations)), proximity sensors, photoelectric sensors, magnetic sensors, and infrared sensors, unless context clearly dictates otherwise.

The use of "tremolo arm" means a mechanism that allows the user to quickly vary the tension, and sometimes length, of the guitar's strings temporarily, unless the context clearly dictates otherwise. This motion changes the guitar's pitch to create a vibrato, portamento, or pitch bend effect.

The use of "pressure pin" means a device configured to engage and disengage the guitar's bridge, keeping it in a fixed or floating position, unless the context clearly dictates otherwise.

The use of "body plate" means a surface configured to engage said pressure pin, enabling the guitar's bridge to remain in a fixed or floating position, unless the context clearly dictates otherwise.

The use of "electronic actuator" means a self-contained actuator that converts electrical energy to mechanical energy to cause motion, unless the context clearly indicates otherwise. Examples of electronic actuator s include, but are not limited to, an electric motor that drives a mechanical rod through a mechanism such as a screw thread to cause motion, a solenoid, servos, and motors.

A number of exemplary guitar tremolo bridges are disclosed herein. While fulcrum-style guitar tremolo bridges are envisioned as the likely use of such devices, it may also be able to be used on other guitars with a tremolo bridge.

Referring initially to FIGS. 1 through 8, a first exemplary guitar tremolo bridge 10 is illustrated in general schematic format. The guitar tremolo bridge 10 is configured for use with a guitar 1 comprising a body 2, a neck 3 attached to said body 2, a headstock 4 attached to said neck 3, a plurality of tuners 5 disposed on said headstock 4 and adjacent the neck 3, at least one post 11 extending from said body 2, each of said at least one post 11, 11' further comprising a V-shaped notch 7, 7' (illustrated in FIG. 2), and a plurality of strings 8, whereby each string of said plurality of strings 8 is attached to the guitar tremolo bridge 10, extends along the neck 3 of the guitar 1, and is attached to a corresponding one of said plurality of tuners 5 disposed on the headstock 4.

The guitar tremolo bridge 10 is mounted to the body 2. The front side of the guitar tremolo bridge 10 has a blade edge 18 that is held in tension against a pair of posts 11, 11' mounted to the body 2 of the guitar 1 by the strings 8 and at least one spring 16. The guitar tremolo bridge 10 is able to pivot at the connection between the blade edge 18 and the posts 11 through use of a tremolo arm 22. While the exemplary guitar tremolo bridges described herein are fulcrum-style tremolo bridges, a skilled artisan will be able to select an appropriate style tremolo bridge for use as the tremolo bridge in a particular embodiment based on various considerations, including the intended use of the tremolo bridge, the intended arena within which the tremolo bridge will be used, and the equipment and/or accessories with which the tremolo bridge is intended to be used, among other considerations.

The guitar tremolo bridge 10 can be utilized in a free-floating position and in a fixed position. In the free-floating position (illustrated in FIGS. 3, 4, 5 and 7), the guitar tremolo bridge 10 is able to pivot at the connection between the blade edge 18 and the posts 11. Thus, the rear side 9 of the guitar tremolo bridge 10 "floats" and is not fixed in position relative to the body 2 of the guitar 1. Conversely, in the fixed position (illustrated in FIGS. 6 and 8), the locking mechanism 26 is engaged to fix the guitar tremolo bridge 10 in position relative to the body 2 of the guitar 1.

Figure 3:
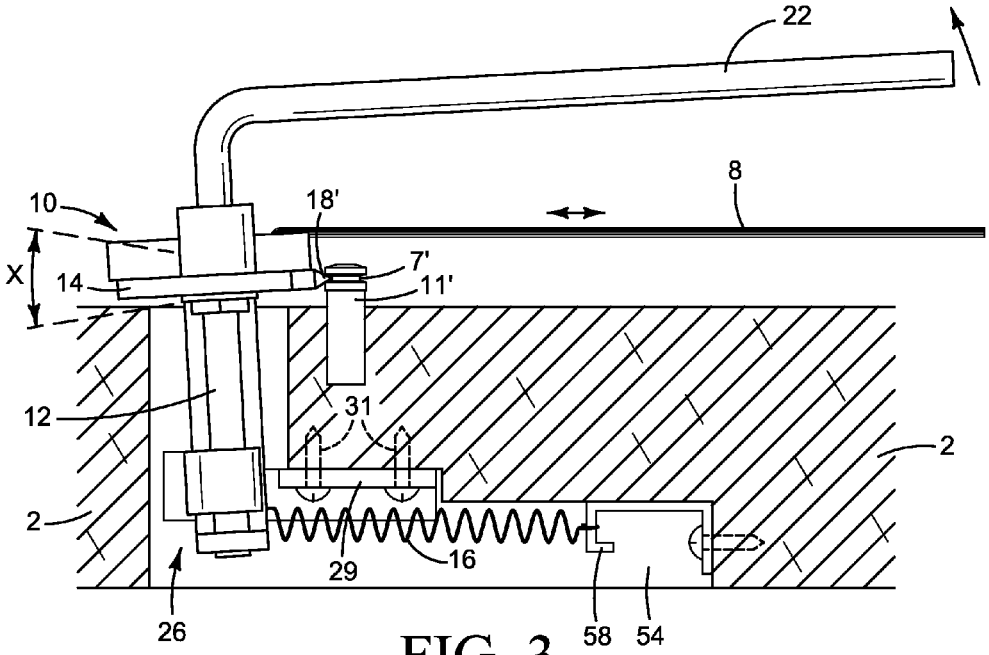
FIG. 3 is a partial, cross-sectional elevation view of the first exemplary guitar tremolo bridge.
Figure 4:
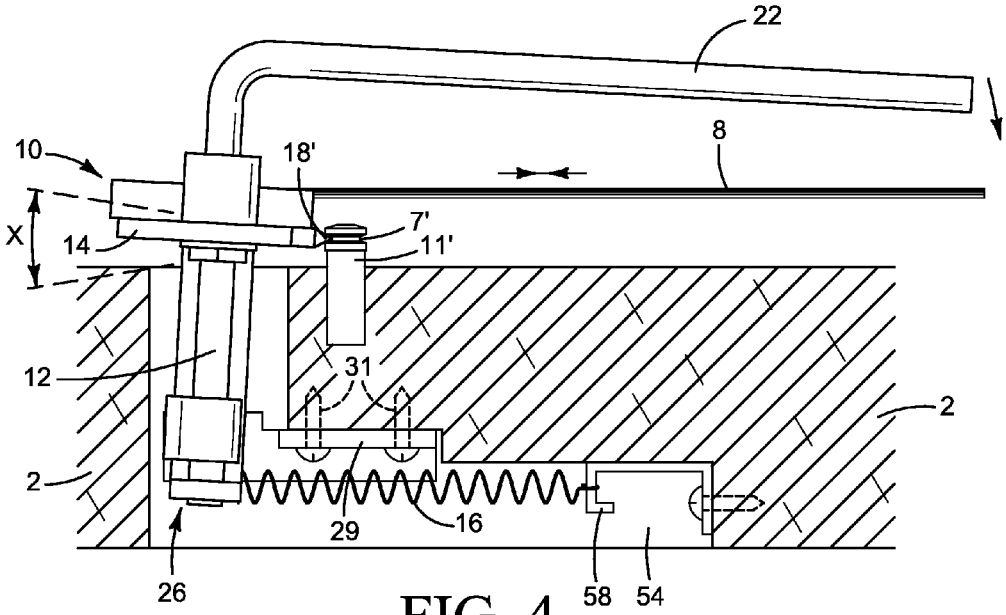
FIG. 4 is a partial, cross-sectional elevation view of the first exemplary guitar tremolo bridge.

The guitar tremolo bridge 10 comprises a block 12 and a base plate 14. The block 12 extends into the body 2 of the guitar 1 and connects to the body 2 of the guitar 1 via a plurality of springs 16. The base plate 14 comprises a blade edge 18 that is configured for receipt into a V-shaped notch 7, 7' and "floats" via a connection to the two posts 11, 11'. The base plate 14 has a rear side 20 opposite the blade edge 18. The guitar's strings 8 attach to the guitar tremolo bridge 10, and extend to the headstock 4 of the guitar 1. In such a configuration, the rear side 20 of the base plate 14 can be moved upwards or downwards along an arc X, as illustrated in FIGS. 3 and 4.

The guitar tremolo bridge 10 further comprises a tremolo arm 22. The tremolo arm 22 configured for attaching to the block 12 at a connection point 24. The tremolo arm 22 is preferably freely rotatable about the connection point 24. The tremolo arm 22 providing a lever which a guitar player can manipulate to move the rear side 20 of the base plate 14 of the guitar tremolo bridge 10 upwards and downwards along the arc X. Rotation of the tremolo arm 22 causes rotation of a shaft 13 extending downwards from the connection point 24.

Figure 5:
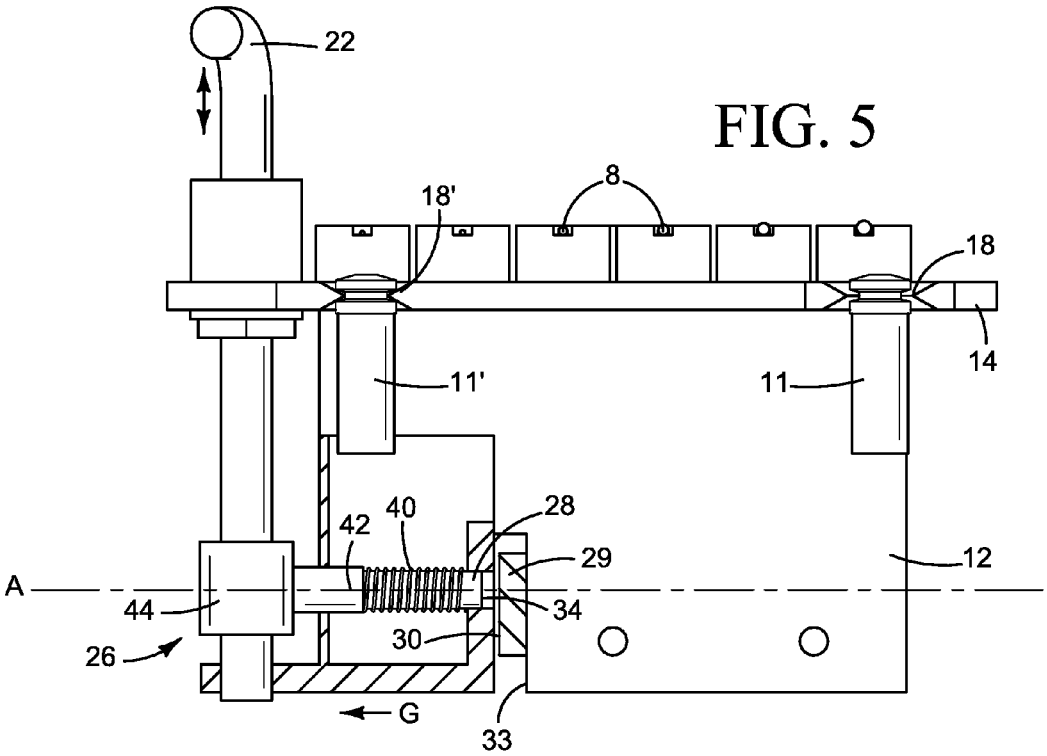
FIG. 5 is a partial, cross-sectional front view of the first exemplary guitar tremolo bridge.
Figure 6:
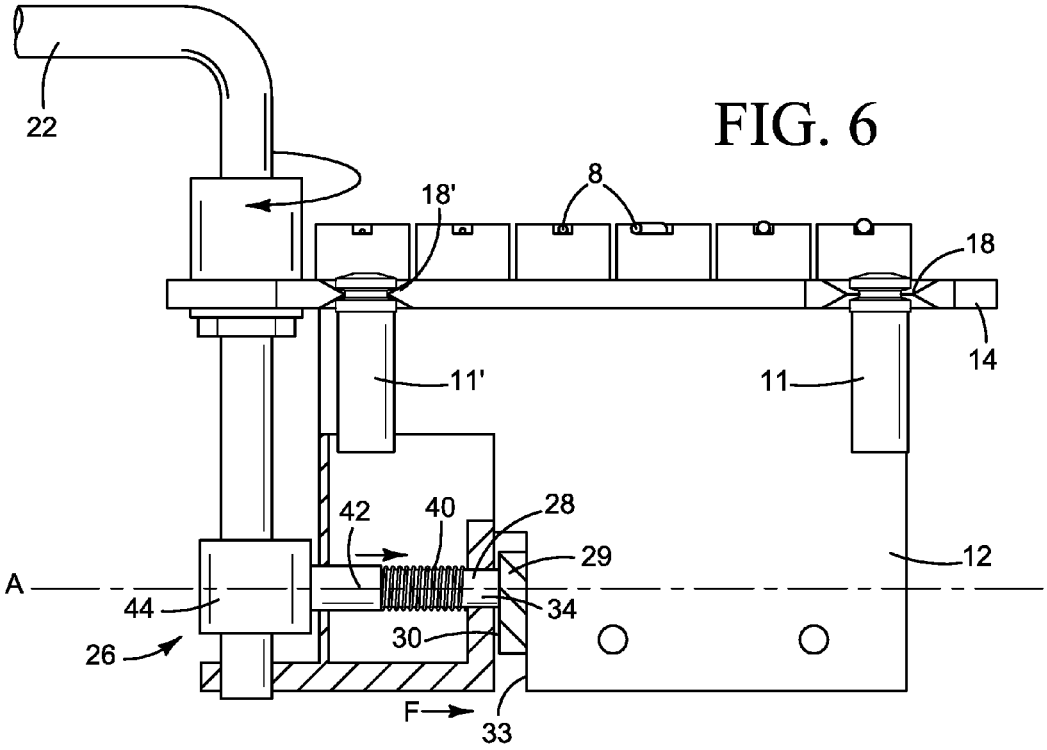
FIG. 6 is a partial, cross-sectional front view of the first exemplary guitar tremolo bridge.
Figure 8:
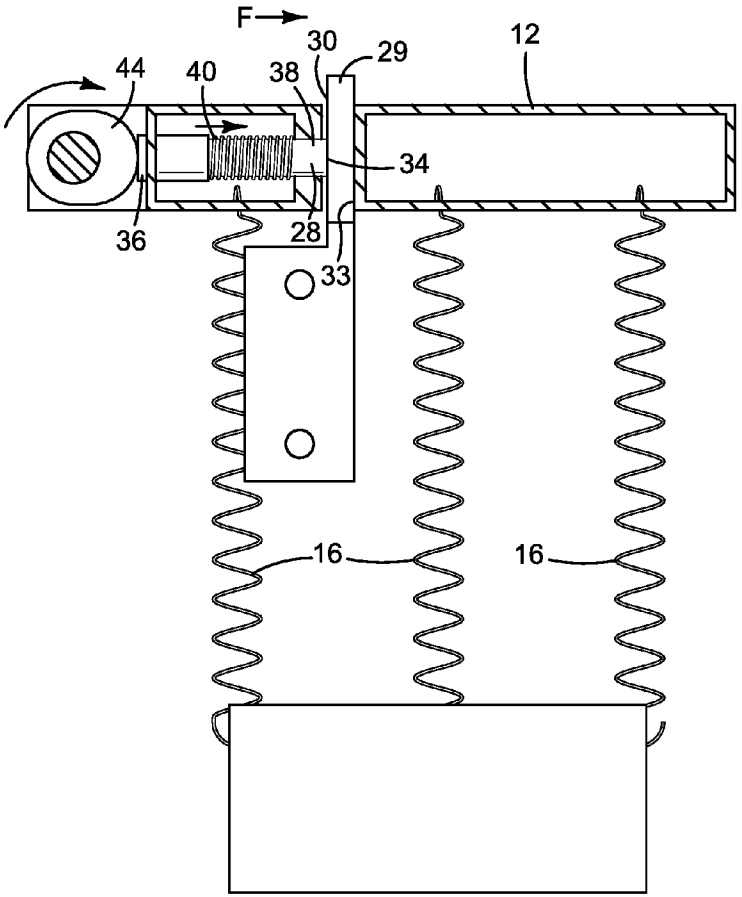
FIG. 8 is a partial, bottom schematic view of the first exemplary guitar tremolo bridge.
Figure 7:
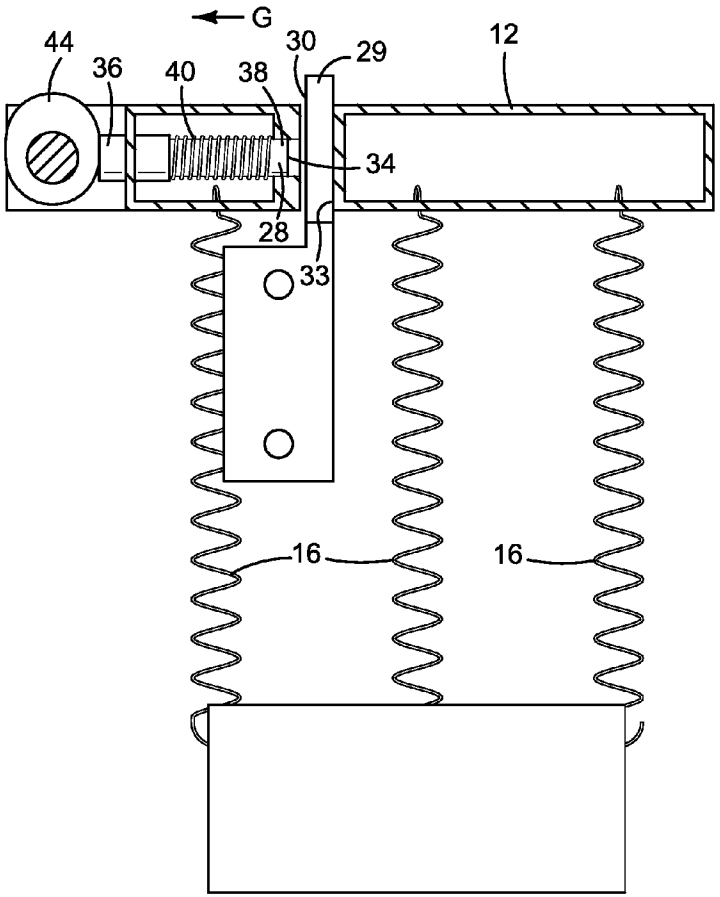
FIG. 7 is a partial, bottom schematic view of the first exemplary guitar tremolo bridge.

Connected to the tremolo arm 22 is a locking mechanism 26 for locking the guitar tremolo bridge 10 in position relative to the body 2 of the guitar 1 along the arc X. The tremolo arm 22 is rotatable between an unlocked position and a locked position. As illustrated in FIG. 6, when the tremolo arm 22 is rotated so that the locking mechanism 26 is in its locked position, the guitar tremolo bridge 10 is locked and held in its then-current position relative to the body 2. Conversely, when the tremolo arm 22 is rotated so that the locking mechanism 26 is in its unlocked position, as illustrated in FIGS. 3, 4, and 5, the guitar tremolo bridge 10 is capable of tilting freely along the defined arc X.

By fixing the guitar tremolo bridge 10 in its then-current position relative to the body 2, a change in string tension (i.e., an intentional bend to the string, or broken string) of one string does not cause the rest of the strings to go out of tune. This allows players to do all of the "Nashville double stops" they want without tuning issues. If the player wants to later use the guitar tremolo bridge 10, they can rotate the tremolo arm 22 back to its unlocked position, and the locking mechanism 26 is disengaged.

In the first exemplary guitar tremolo bridge 10 illustrated in these figures, the locking mechanism 26 can further comprises a body plate 29. The body plate 29 configured for attachment to the body 2 of the guitar 1, for instance through fasteners 31, as illustrated in FIGS. 3 and 4. The body plate 29 is thereby fixed in position relative to the guitar tremolo bridge 10.

The locking mechanism 26 further comprises a pressure pin 28. In the first exemplary guitar tremolo bridge 10 illustrated in FIGS. 5 and 6, the pressure pin 28 extends through the block 12. The pressure pin 28 has an axis A defined as running through its midpoint which is generally parallel to the body of the pressure pin 28. The pressure pin 28 is configured for movement in a first direction F towards the contact surface 30, and in a second direction G away from the contact surface 30. The pressure pin 28 comprises a first end 36 extending to a second end 38, wherein the second end 38 comprises a tip 34.

The body plate 29 defines a contact surface 30 generally perpendicular to the pressure pin 28 axis A. In FIGS. 5 and 6, the contact surface 30 comprises the side of the body plate 29. The body plate 29 is configured for receipt between the tip 34 of the pressure pin 28 and a contact surface 30 of the block 12. It is preferred that the contact surface 30 be generally perpendicular to the pressure pin 28 axis A.

Preferably, the second end 38 comprises a locking portion 32. When the tremolo arm 22 is rotated into its locked position illustrated in FIG. 6, the guitar tremolo bridge 10 is held in its then-current position by compression between the tip 34 of the pressure pin 28 against the contact surface 30. The pressure pin 28 is extended to meet the contact surface 30 through the use of a spring 40 operatively connected to the tremolo arm 22 and pressure pin 28. Conversely, when the tremolo arm 22 is rotated into its unlocked position, the compressive force is removed, and the spring 40 returns the pressure pin 28 to its retracted position, thus the guitar tremolo bridge 10 is able to tilt freely.

Preferably, the first end 36 of the pressure pin 28 can comprise a boss 42, and the locking mechanism 26 can comprise a cam member 44 on the shaft 13 configured for manipulation by the tremolo arm 22. The cam member 44 is configured to engage the boss 42, wherein rotation of the tremolo arm 22 into its locked position rotates the shaft 13 and causes the cam member 44 to engage the boss 42. Upon the cam member 44 engaging the boss 42, a spring 40 extends the pressure pin 28 in the first direction F. This movement causes the guitar tremolo bridge 10 to be locked in its then-current position. Conversely, when the tremolo arm 22 is rotated into its unlocked position, the cam member 44 disengages from the boss 42 and the spring 40 retracts the pressure pin 28. Thus, the guitar tremolo bridge 10 is able to tilt freely.

Referring now to FIGS. 9 through 13, the second exemplary guitar tremolo bridge 110 is illustrated. The second exemplary guitar tremolo bridge 110 is similar to the first exemplary guitar tremolo bridge 10 illustrated in FIGS. 1 through 8 and described above, except as detailed below. Thus, the second exemplary guitar tremolo bridge 110 includes a base plate 114, a blade edge 118, a rear side 120, a tremolo arm 122, and a locking system 125.

In the second exemplary guitar tremolo bridge 110, the locking system 125 comprises an electronic locking mechanism 127. In the second exemplary guitar tremolo bridge 110, the electronic locking mechanism 127 comprises a brake rod 146 connecting to the block 112, and a brake portion 148 attached to the body 102 of the guitar 101. The electronic locking mechanism 127, based on an electrical charge (or absence thereof) or based on a signal received (or absence thereof), comprises a brake portion 148 that clamps or otherwise restricts the movement of the brake rod 146. The use of "rod" within "brake rod 146" is not intended to serve as a limitation on the shape of the brake rod 146, which may be rod shaped, elongated, a flange, a tab, or other such suitable structure.

Figure 9:
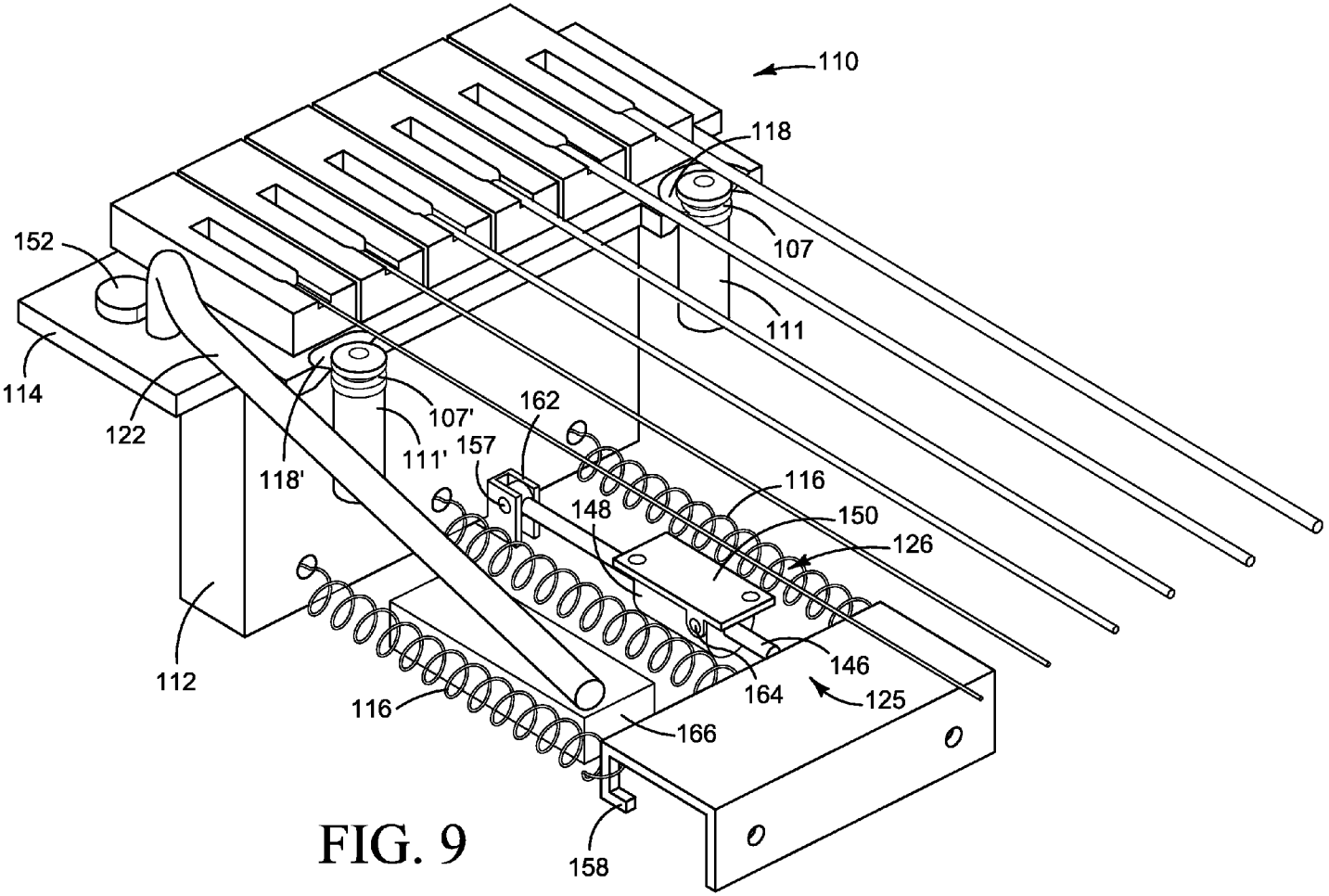
FIG. 9 is a partial, second side top perspective view of a second exemplary guitar tremolo bridge.

The electronic locking mechanism 127 illustrated in FIG. 9 is located in the tremolo recess 154 defined in the back side of the body 2 of the guitar 101. For instance, the electronic locking mechanism 127 could be located in one of the unused tremolo spring slots 55 (the counter-balance springs) in the tremolo recess 154.

The electronic locking mechanism 127 could be activated a number of different ways, including the ways discussed herein. A skilled artisan will be able to select an appropriate activation manner for the electronic locking mechanism in a particular embodiment based on various considerations, including the intended use of the electronic locking mechanism, the intended arena within which the electronic locking mechanism and tremolo will be used, and the equipment and/or accessories with which the electronic locking mechanism and tremolo is intended to be used, among other considerations.

Figure 10:
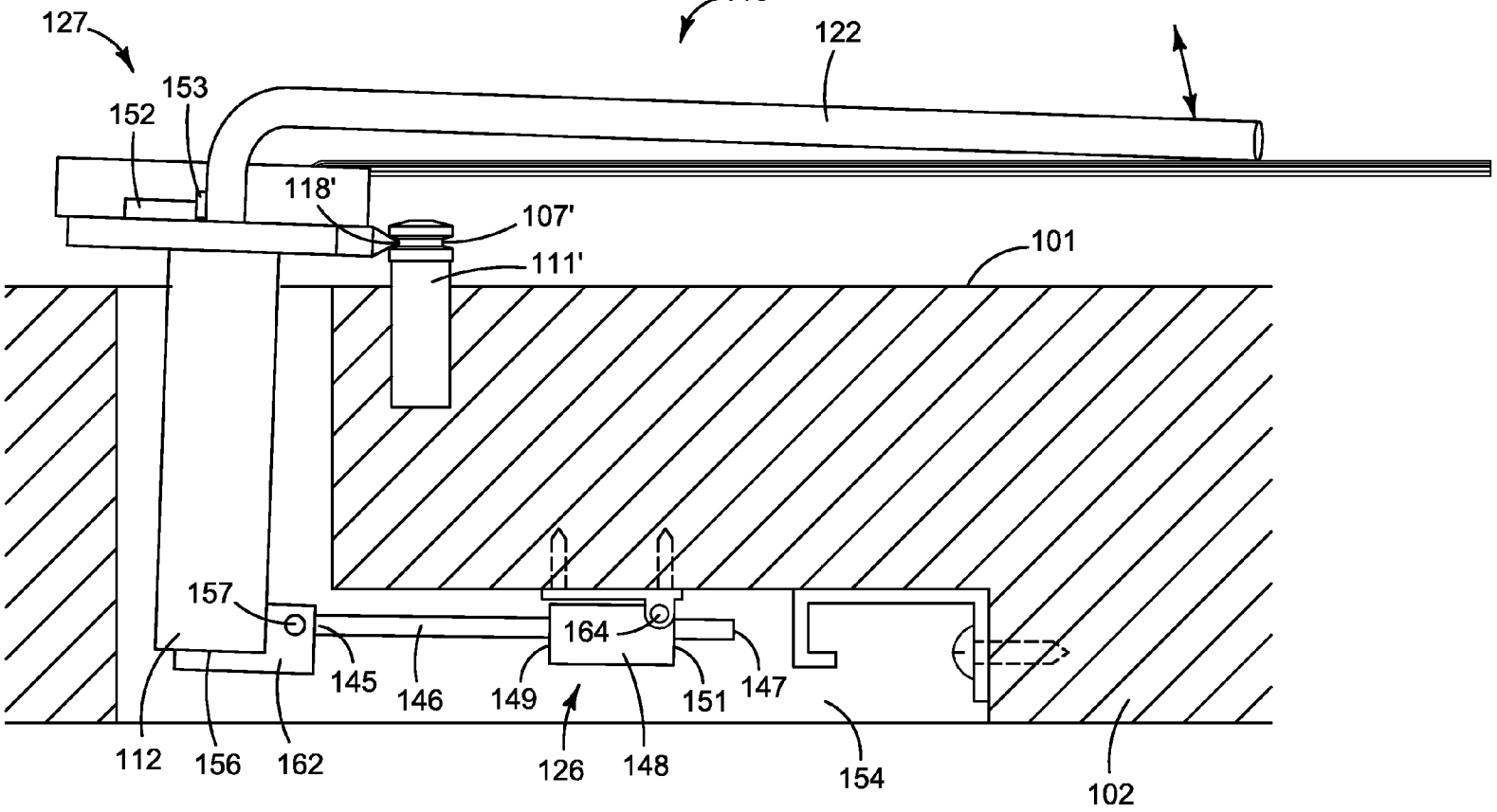
FIG. 10 is a partial, side cross-sectional view of the second exemplary guitar tremolo bridge.
Figure 11:
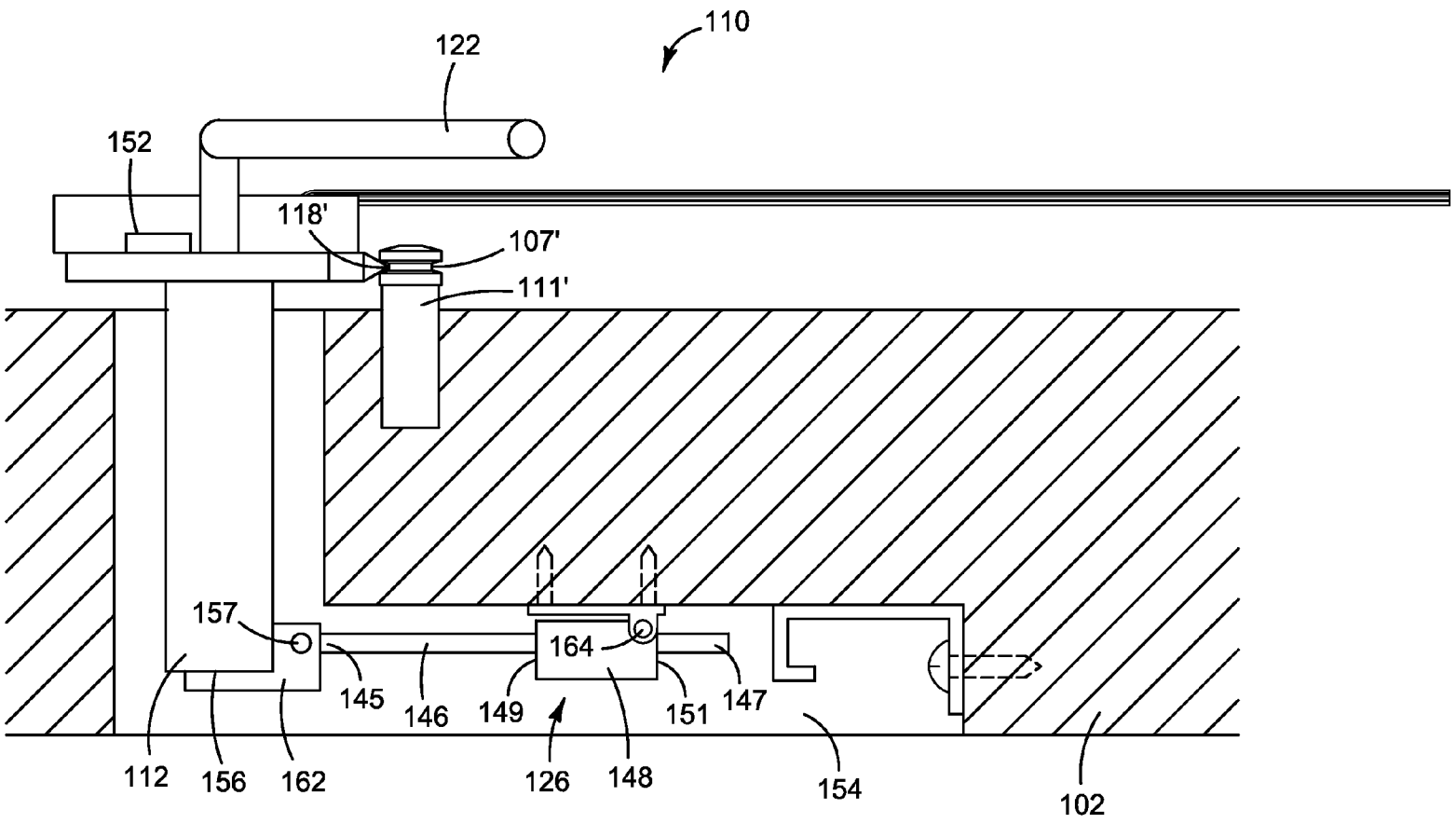
FIG. 11 is a partial, side cross-sectional view of the second exemplary guitar tremolo bridge.
Figure 12:
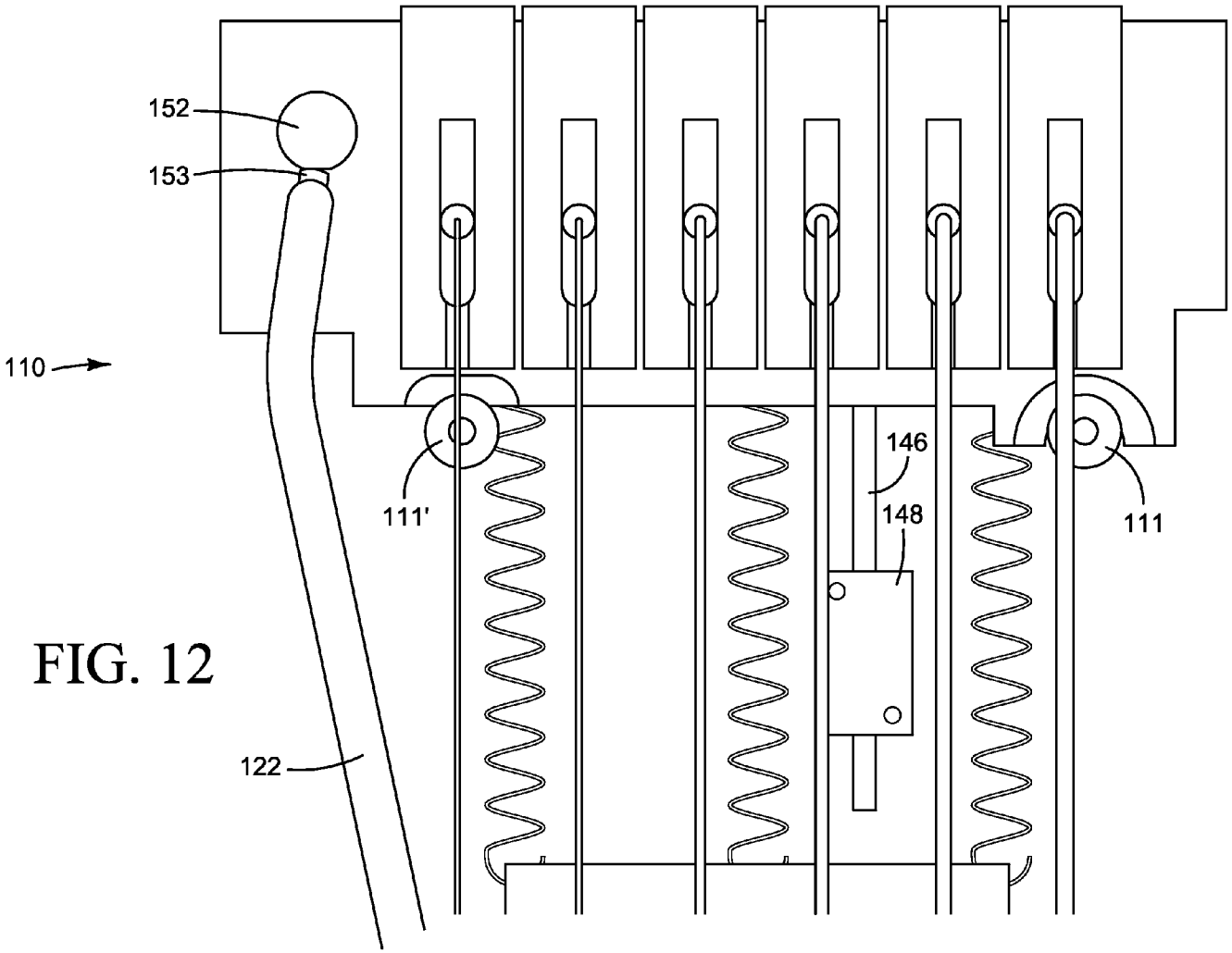
FIG. 12 is a partial, top plan view of the second exemplary guitar tremolo bridge.
Figure 13:
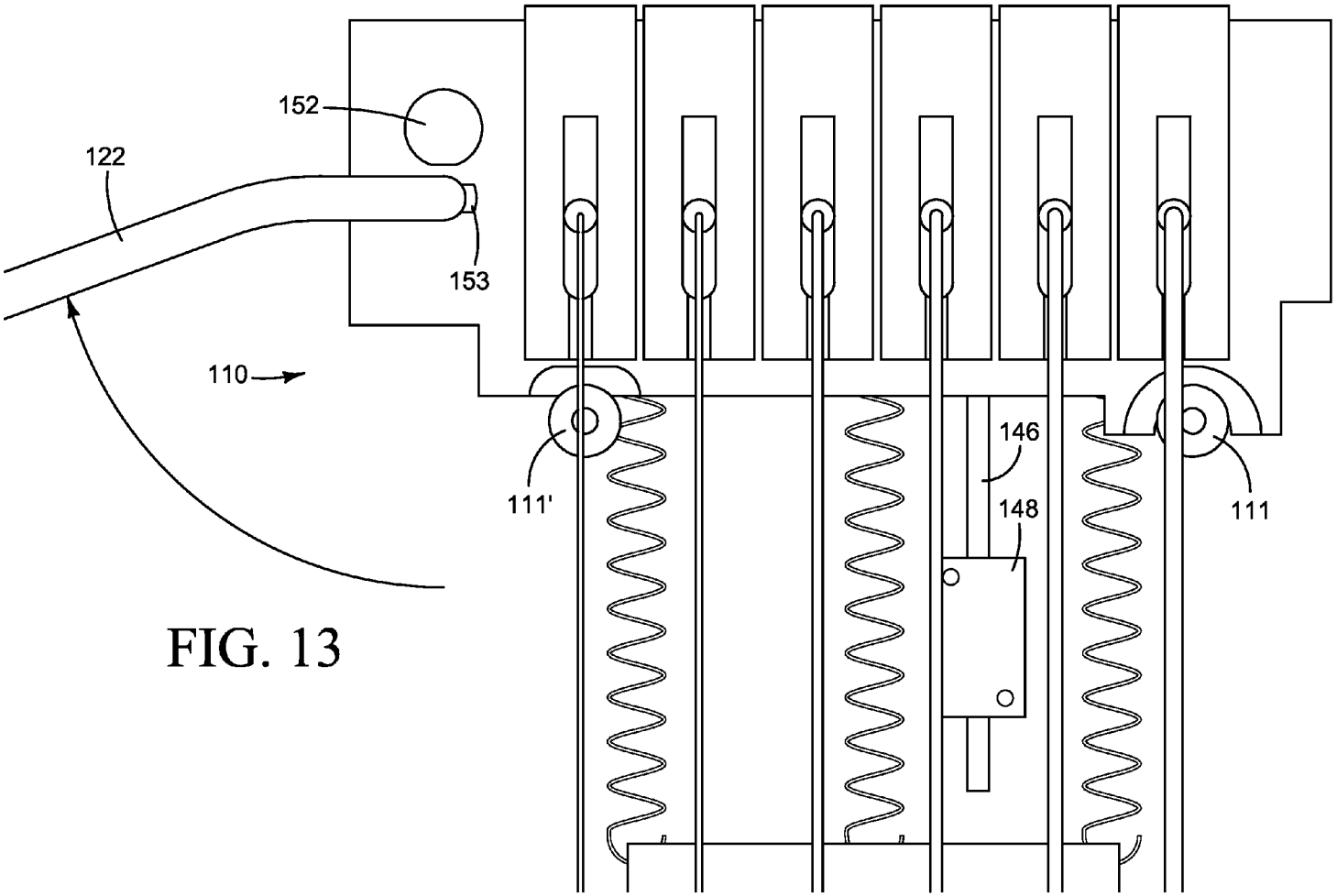
FIG. 13 is a partial, top plan view of the second exemplary guitar tremolo bridge.

Referring to FIG. 10, the electronic locking mechanism 127 comprises a connector 156 attaching to the block 112. A brake rod 146 is elongated, having a first end 145 and a second end 147. The brake rod 146 hingedly connects at its first end 145 with the connector 156 via a pivot 157. The second end 147 located distally from the block 112, preferably extending towards the claw 158 of the guitar 101. The brake rod 146 slidably extends through a brake portion 148, enabling the brake rod 146 to slide forward in a first direction F, and backward in a second direction G, along the longitudinal axis A of the brake rod 146. The brake portion 148 is configured for braking the slidable movement of the brake rod 146 therethrough and locking the brake rod 146 in place.

It is preferred that the electronic locking mechanism 127 comprise an electronic actuator 150 for actuating the brake portion 148, thereby locking the brake rod 146 in place. In the embodiment illustrated in FIG. 10, the brake portion 148 comprises a first portion 149 hingedly connected to a second portion 151, wherein the electronic actuator 150 comprises a solenoid 159 configured for moving the first portion 149 closer to the second portion 151, thereby clamping the brake portion 148 on the brake rod 146 extending therethrough, and moving the first portion 149 away from the second portion 151, thereby unclamping the brake portion 148 from the brake rod 146 and allowing the brake rod 146 to slide freely therethrough. Optionally, the brake portion 148 could be pivotally connected to the body 2 of the guitar 101 at a hinge connector 160.

The electronic actuator 150 could be activated through any suitable manner, including through use of switches, levers, and/or sensors. A skilled artisan will be able to select an appropriate manner of activating the electronic actuator in a particular embodiment based on various considerations, including the intended use of the tremolo bridge, the intended arena within which the tremolo bridge will be used, and the equipment and/or accessories with which the tremolo bridge is intended to be used, among other considerations. For instance, a sensor 152 could be mounted on the guitar 101 or guitar tremolo bridge 110. In the exemplary guitar tremolo bridge 110 illustrated in FIG. 9, sensor 152 is mounted on the guitar tremolo bridge 110 and the tremolo arm 122 such that when the tremolo arm 122 is moved in a first direction F the sensor 152 sends a signal to the electronic actuator 150 causing the electronic actuator 150 to engage the brake portion 148, locking the brake rod 146 therein and fixing the then-current position of the guitar tremolo bridge 110. Conversely, the tremolo arm 122 can be moved in a second direction G and the sensor 152 send a signal to the electronic actuator 150 to release the brake portion 148, unlocking the brake rod 146 and allowing it to slide therethrough, thereby allowing the guitar tremolo bridge 110 to tilt freely. Alternatively, the locking action could be controlled by triggering a switch that is part of a replacement potentiometer, replacing one of the existing ports on the guitar.

Further, the brake portion 148 can be activated by the electronic actuator 150 such that when the brake is activated or deactivated, no power is needed for the brake portion 148 to maintain its position. This improves battery life and such embodiment can be installed to a guitar without any modification.

Figure 14:
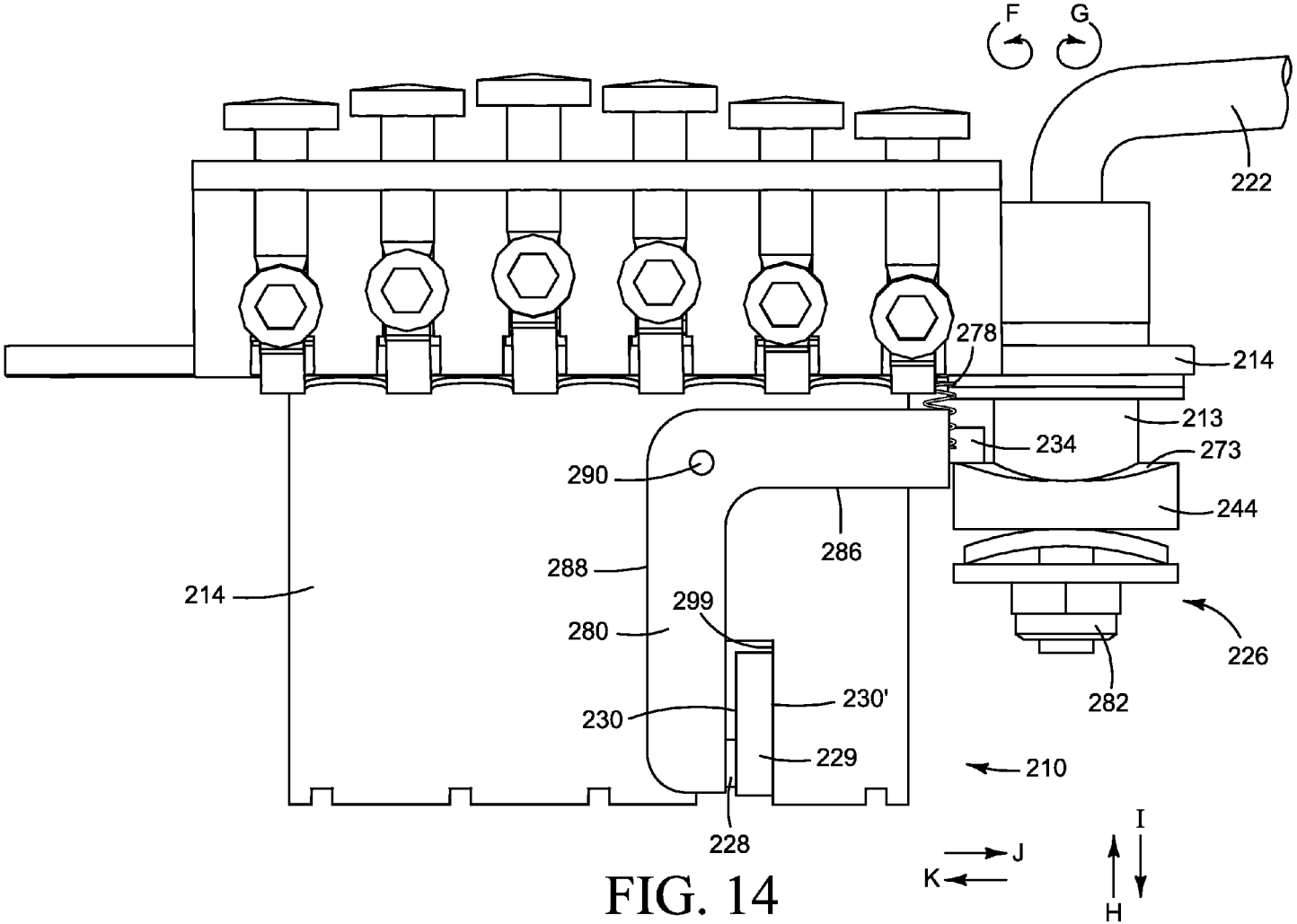
FIG. 14 is a partial, rear side view of a third exemplary guitar tremolo bridge.
Figure 15:
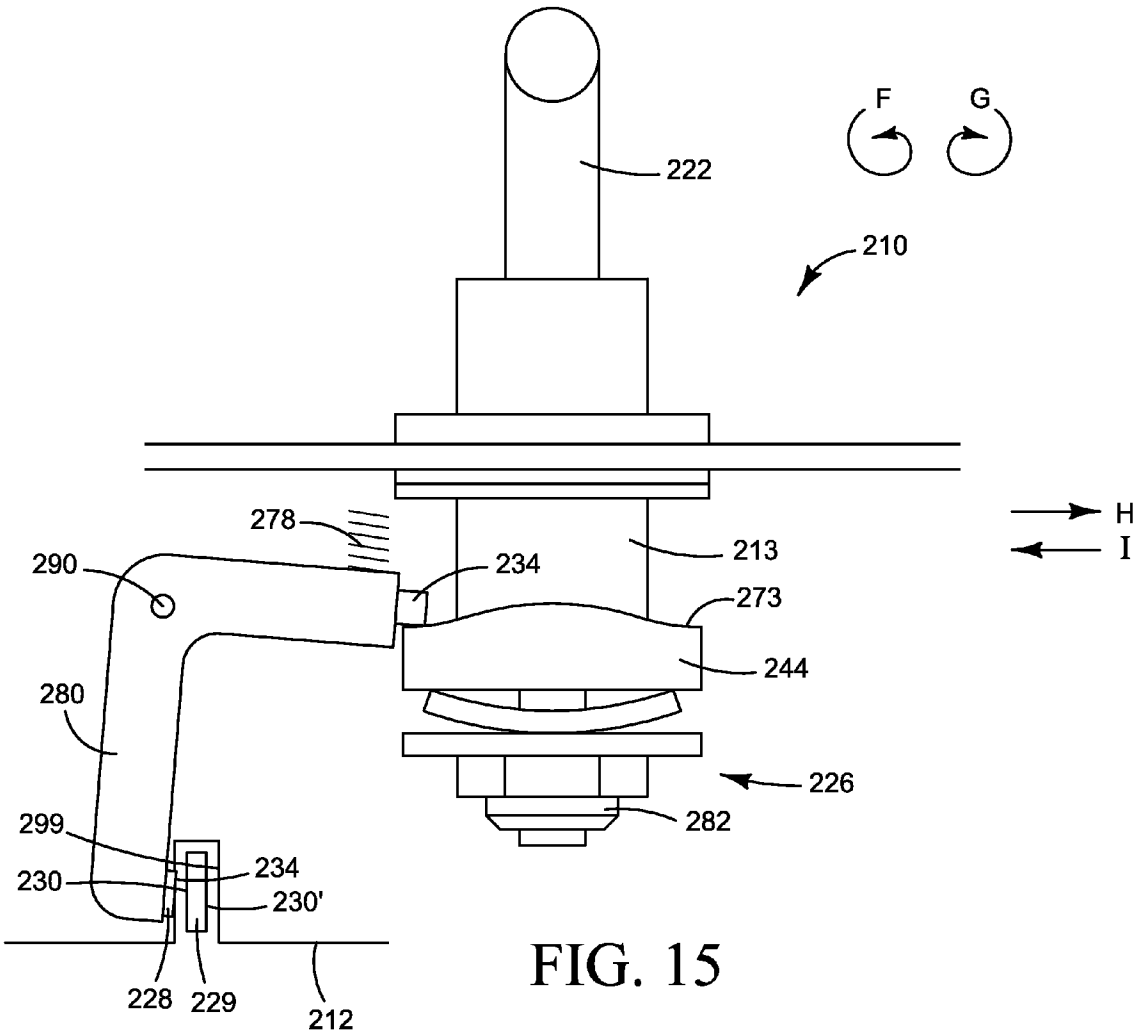
FIG. 15 is a partial, side elevation view of the third exemplary guitar tremolo bridge of FIG. 14 illustrating the unlocked position.
Figure 16:
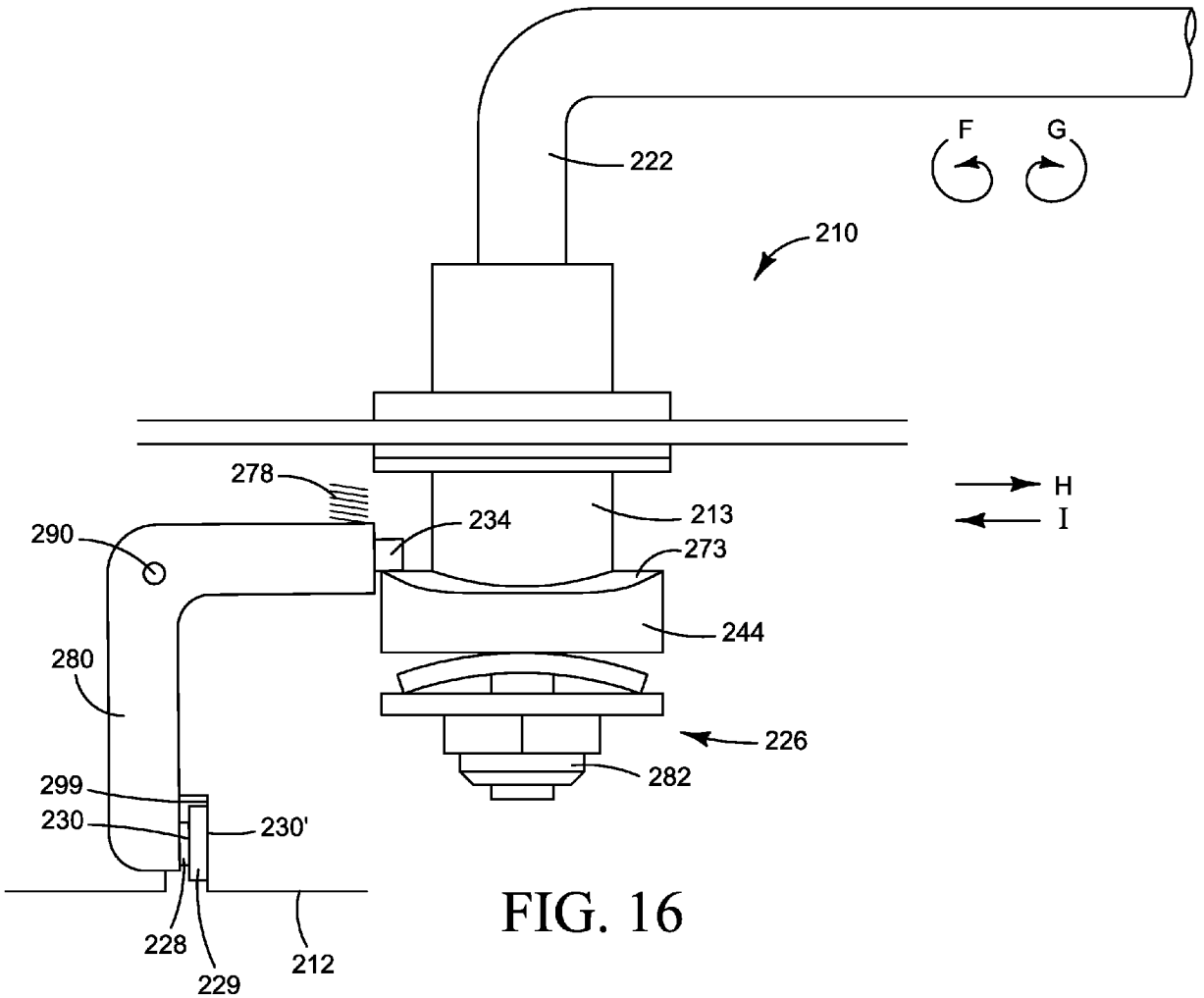
FIG. 16 is a partial, side elevation view of the third exemplary guitar tremolo bridge of FIG. 14 illustrating the locked position.

Referring now to FIGS. 14 through 16, the third exemplary guitar tremolo bridge 210 is illustrated. The third exemplary guitar tremolo bridge 210 is similar to the first exemplary guitar tremolo bridge 10 illustrated in FIGS. 1 through 8 and described above, except as detailed below. Thus, the third exemplary guitar tremolo bridge 210 includes a tremolo bridge 210, block 212, a shaft 213, a base plate 214, a tremolo arm 222, a locking mechanism 226, a pressure pin 228, a body plate 229, a contact surface 230, a tip 234, and a cam member 244.

The locking mechanism 226 for locking the guitar tremolo bridge 210 in position relative to the body of the guitar along the arc which the guitar tremolo bridge 210 is configured to pivot. The tremolo arm 222 is rotatable between an unlocked position and a locked position. As illustrated in FIGS. 15 and 16, when the tremolo arm 222 is rotated so that the locking mechanism 226 is in its locked position (FIG. 16), the guitar tremolo bridge 210 is locked and held in its then-current position relative to the body. Conversely, when the tremolo arm 222 is rotated so that the locking mechanism 226 is in its unlocked position (FIG. 15), the guitar tremolo bridge 210 is capable of tilting freely along the defined arc. The body plate 229 attaches to the body of the guitar, and is fixed in position relative to the guitar tremolo bridge 210.

The locking mechanism 226 further comprises a pivot arm 280 having a first leg 286 comprising a tip 234 and a second leg 288 comprising a pressure pin 228, and a cam member 244 attached about the shaft 213. Rotation of the tremolo arm 222 causes rotation of the shaft 213 and rotation of the cam member 244.

The cam member 244 is generally circular in shape when viewed from a top perspective and is located about the shaft 213 such that rotation of the tremolo arm 222 and shaft 213 rotates the cam member 244. The cam member 244 comprises a top planar surface, which serves as a contact point for the tip 234 when the tremolo arm 222 is in its engaged position. Furthermore, the cam member 244 comprises a notch 273 extending below its top planar surface, which also serves as a contact point for the tip 234. The notch 273, however, serves as a contact point when the tremolo arm 222 is in its disengaged position. Thus, when viewed from a side perspective, the cam member 244 is an elongated "U" shape.

The body plate 229 defines a first contact surface 230, 230'. In FIGS. 14 through 16, the contact surface 230 comprises a first side of the body plate 229, and the contact surface 230' comprises a second side of the body plate 229. The body plate 229 is configured for receipt between the tip 234 of the pressure pin 228 and a contact surface 230 of the block 212.

The pivot arm 280 comprises a tip 234 for engaging with the cam member 244 and notch 273. The tip 234 extends from the pivot arm 280 such that rotation of the tremolo arm 222 rotates the shaft 213 which, in turn, rotates the cam member 244. This rotation causes the tip 234 to either engage the notch 273 or cam member 244. When the tip 234 is engaged with the notch 273 pressure arm 280 is disengaged from the body plate 229. This allows the tremolo bridge 210 to free-float. Conversely, when the tip 234 is engaged with the cam member 244 the pressure arm 280 engages the body plate 229, causing the tremolo bridge 210 to be fixed in its then-current position.

The pivot arm 280 comprises a first leg 286 and second leg 288. The arm is preferably "L" shaped, having a tip 234 extending from its first leg 286. Further, the second leg 288 comprises a pressure pin 228 extending therefrom. The pivot arm 280 is pivotally mounted to the block 212 by a pivoted connection 290, allowing the pivot arm 280 to "rock"; vertical movement of the first leg 286 causes horizontal movement of the second leg 288 and horizontal movement of the second leg 288 causes vertical movement of the first leg 286. Thus, when exerting an upward vertical force on the tip 234 the second leg 288 extends in a first horizontal direction, affixing the pressure pin 228 to the body plate 229.

When the tremolo arm 222 is rotated in a first direction F the shaft 213, too, is rotated in a first direction F. This movement rotates the cam member 244 such that it either supports the tip 234 attached to the first leg 286 of the pivot arm 280 or the tip 234 rests in the notch 273. When the tip 234 is supported by the cam member 244, an upward vertical force H is exerted upon the tip 234, causing a horizontal reaction by the pressure pin 228 in a first horizontal direction J. This horizontal force J causes the pressure pin 228 to come into contact with contact surface 230 of the body plate 229, forcing the contact surface 230' of the body plate 229 against the block contact surface 299, locking the tremolo bridge 210 in its then-current position. Conversely, when the tremolo arm 222 is rotated in a second direction G the shaft 213, too, is rotated in a second direction G. This movement rotates the cam member 244, causing the tip 234 to rest in the notch 273. In this configuration, a downward vertical force I is exerted on the tip 234, causing a horizontal reaction by the pressure pin 228 in a second horizontal direction K. This horizontal reaction K causes the pressure pin 288 to retract from the body plate 229, allowing the tremolo bridge 210 to float freely.

A spring 278 is located between the back side of the pivot arm 280 and the block 212. As the cam member 244 is rotated by the tremolo arm 222 and shaft 213, the spring exerts a downward force I on the tip 234. This downward force I causes the tip 234 to be secured in place, whether resting upon the cam member 244 or within the notch 273.

Located adjacent the guitar's body plate 229 is an adjustable shoe 276. The adjustable shoe 276 acts as a surface against which the body plate 229 is clamped and can be moved in a first direction towards body plate 229 and in a second direction away from the body plate 229. By moving the adjustable shoe 276 in its first direction, the tremolo arm 222 must be rotated a greater amount in order for the pivot arm 280 to contact the body plate 229. Conversely, when the adjustable shoe 276 is rotated in its second direction, the tremolo arm 222 must be rotated a lesser amount in order for the pivot arm 280 to contact the body plate 229.

In addition to an adjustable shoe 276, the third exemplary guitar tremolo bridge comprises a bolt 282 for adjusting the cam member 244. The bolt 282 is rotatable in a first direction F and second direction G such that tightening it in its first direction F raises the cam member 244. When the cam member 244 is raised the tremolo arm 222 must overcome additional resistance to rotate. Conversely, when the bolt 282 is rotated in its second direction G the cam member 244 is lowered and the tremolo arm 222 must overcome less resistance to rotate.

Figure 17:
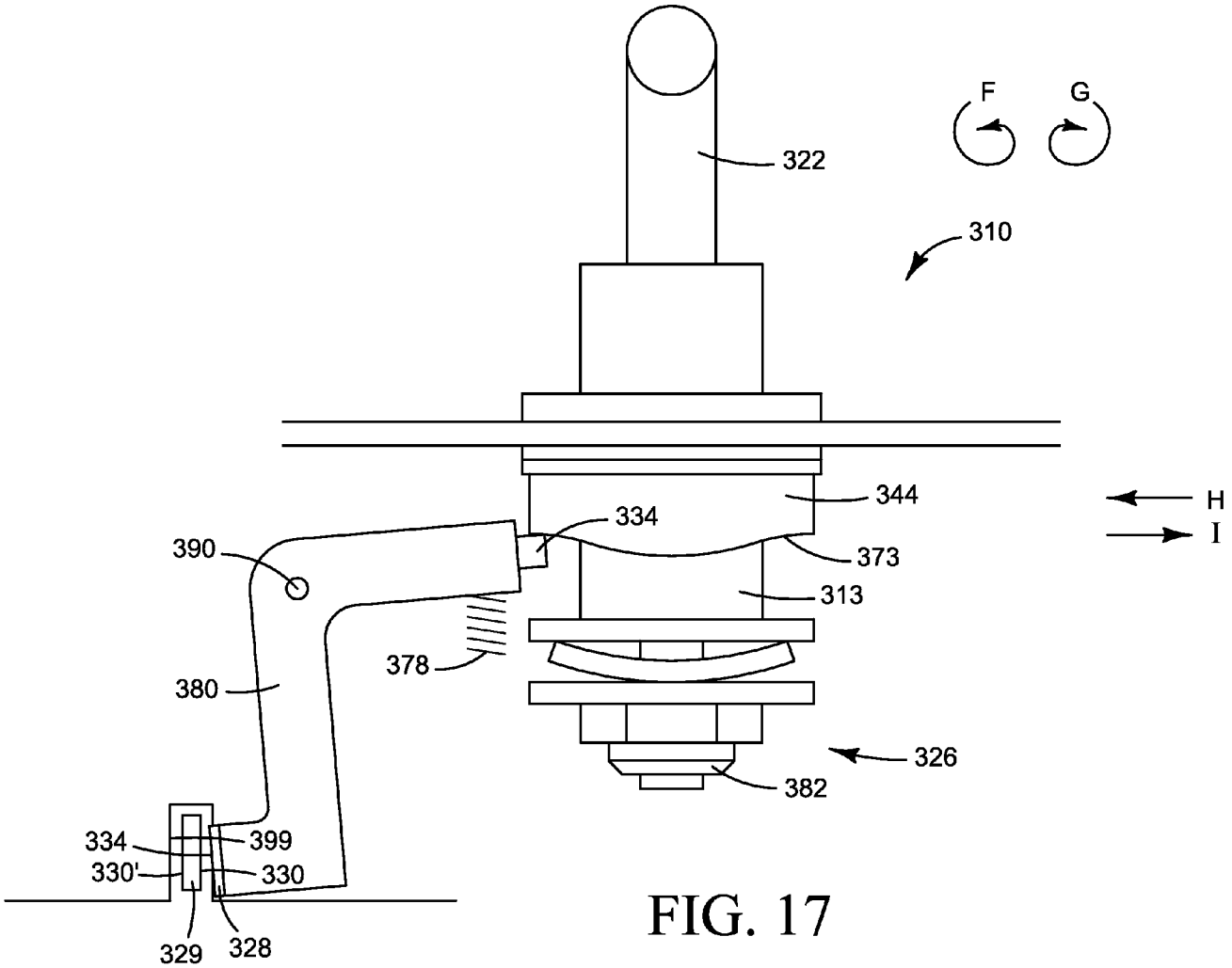
FIG. 17 is a partial, side elevation view of the fourth exemplary guitar tremolo bridge illustrating the unlocked position.
Figure 18:
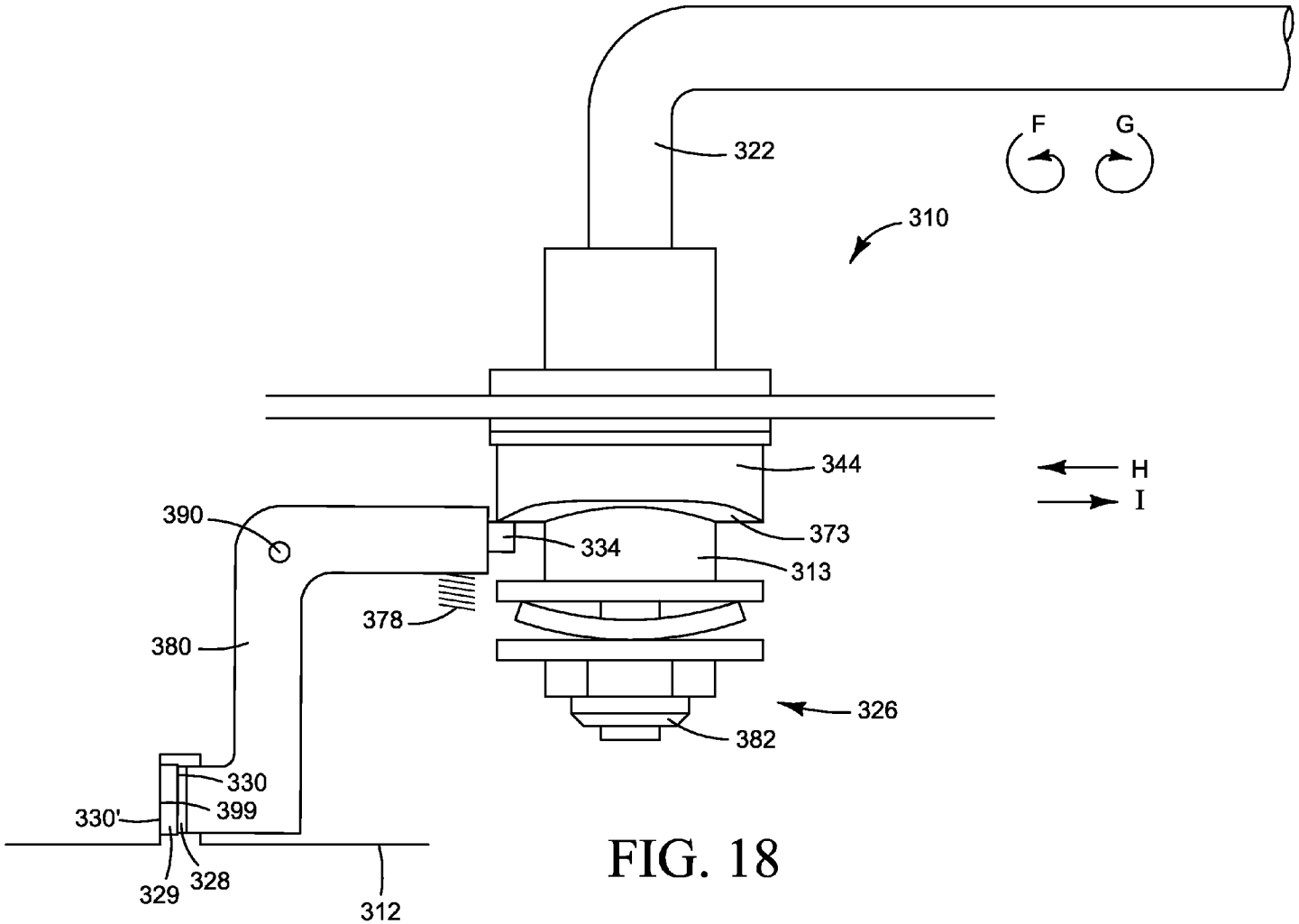
FIG. 18 is a partial, side elevation view of the fourth exemplary guitar tremolo bridge of FIG. 17, illustrating the locked position.

Referring now to FIGS. 17 and 18, the fourth exemplary guitar tremolo bridge 310 is illustrated. The fourth exemplary guitar tremolo bridge 310 is similar to the third exemplary guitar tremolo bridge 210 illustrated in FIGS. 14 through 16 and described above, except as detailed below. Thus, the fourth exemplar guitar tremolo bridge 310 includes a tremolo bridge 310, block 312, a shaft 313, a tremolo arm 322, a locking mechanism 326, a pressure pin 328, a body plate 329, a contact surface 330, a tip 334, a cam member 444, a notch 373, an adjustable shoe 376, a spring 378, a pivot arm 380, a bolt 382, a first leg 386, a second leg 388, and a pivot connection 390.

The fourth exemplary guitar tremolo bridge 310 is configured in a manner opposite the third exemplary guitar tremolo bridge 210. When the tremolo arm 322 of the fourth exemplary guitar tremolo bridge 310 is rotated in a first direction F the shaft 313, too, is rotated in a first direction F. This movement rotates the cam member 344 such that it supports the tip 334. When the cam member 344 supports the tip 334, the pivot arm 380 rotates about its pivoted connection 390; the tip 334 exerts a downward vertical force I on the spring 378 and the pressure pin 328 exerts a horizontal force K on the contact surface 330 of the body plate 329, forcing the contact surface 330' of the body plate 329 against the block contact surface 399. This horizontal force K holds the tremolo bridge 322 in its then-current position. Conversely, when the tremolo arm 322 is rotated in a second direction G the shaft 313, too, is rotated in a second direction G. This movement rotates the cam member 344 out from the tip 334, causing the tip 334 to rest in the notch 373. When the tip 334 rests in the notch 373, the spring 378 exerts an upward vertical force H on the tip 334 and the pressure pin 328 retracts from the body plate 329, allowing the tremolo bridge 310 to float freely.

Figure 19:
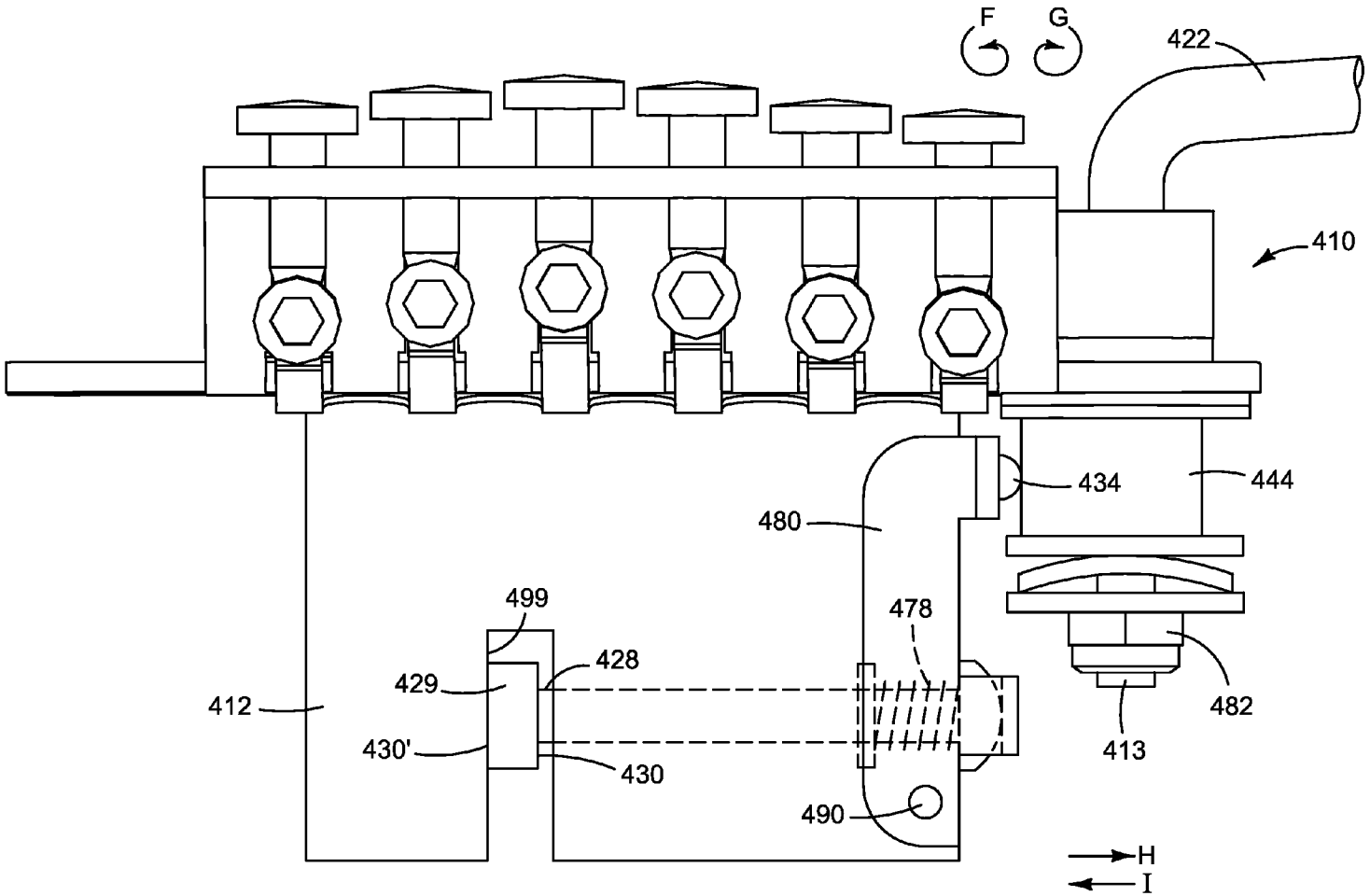
FIG. 19 is a partial, rear side view of a fifth exemplary guitar tremolo bridge illustrating the locked position.
Figure 20:
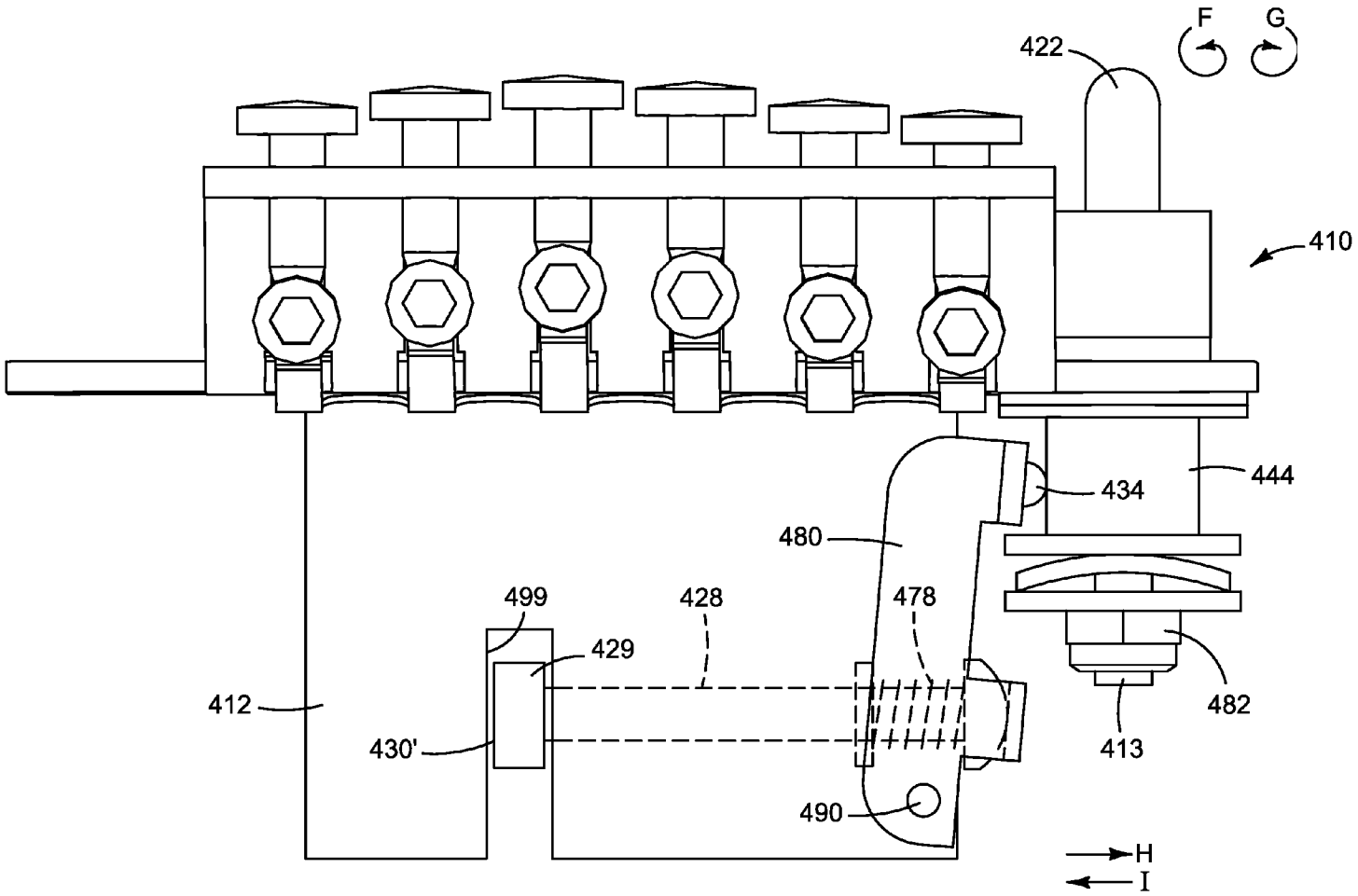
FIG. 20 is a partial, rear side view of the fifth exemplary guitar tremolo bridge of FIG. 19, illustrating the unlocked position.

Referring now to FIGS. 19 and 20 the fifth exemplary guitar tremolo bridge 410 is illustrated. The fifth exemplary guitar tremolo bridge 410 is similar to the third exemplary guitar tremolo bridge 210 illustrated in FIGS. 14 through 16 and described above, except as detailed below. Thus, the fifth exemplary guitar tremolo bridge 410 includes a tremolo bridge 410, shaft 413, tremolo arm 422, pressure pin 428, body plate 429, contact surface 430, 430', tip 434, cam member 444, notch 473, pivot arm 480, bolt 482, pivoted connection 490, and block contact surface 499.

The fifth exemplary guitar tremolo bridge 410 is oriented horizontally manner when compared with the third exemplary guitar tremolo bridge 210. When the tremolo arm 422 is rotated in a first direction F the shaft 413, too, is rotated in a first direction F. This movement rotates the cam member 444 such that it exerts a horizontal force on the pin 484 attached to the first leg 486 of the pressure arm 480. When a force is exerted on the tip 434, the pressure arm 480 rotates about its pivoted connection 490; the first leg 486 moves in a first horizontal direction K and the second leg 488 moves in a second horizontal direction J, thus exerting a horizontal force on the contact surface 430 of the body plate 429, forcing the contact surface 430' of the body plate 429 against the block contact surface 499. This horizontal force holds the tremolo bridge 422 in its then-current position. Conversely, when the tremolo arm 422 is rotated in a second direction G the shaft 413, too, is rotated in a second direction G. This movement rotates the cam member 444 out from the tip 434, causing the tip 434 to rest in the notch 473. When the tip 434 rests in the notch 473, the second leg 488 moves in a first horizontal direction K and retracts from the body plate 429. This configuration allows the tremolo bridge 422 to float freely.

Any suitable structure and/or material can be used for the components of exemplary guitar tremolo bridges, and a skilled artisan will be able to select an appropriate structure and material for the exemplary guitar tremolo bridge in a particular embodiment based on various considerations, including the intended use of the guitar, the intended arena within which the guitar will be used, and the equipment and/or accessories with which the guitar is intended to be used, among other considerations.

It is noted that all structure and features of the various described and illustrated embodiments can be combined in any suitable configuration for inclusion in an exemplary guitar tremolo bridge according to a particular embodiment. For example, an exemplary guitar tremolo bridge according a particular embodiment can include neither, one, or both of mechanical locks and electro-mechanical locks described above.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising:

a base plate including at least one pivot point, said at least one pivot point of said base plate engaging said V-shaped notch to allow for tilting movement of the tremolo bridge along an arc;

a block extending from said base plate;

at least one spring connecting said block to said body, said at least one spring for counter-balancing the tension of the strings of the guitar and maintaining the tremolo bridge in a default position;

a tremolo arm attached to said base plate, said tremolo arm having a first portion and a second portion, said first portion attached to said base plate and said second portion extending angularly from said first portion, said first portion defining a first portion axis along a length thereof, said tremolo arm being rotatable about a swing axis defined generally parallel to said first portion axis and connected to said base plate; and an adjustable locking mechanism for locking the position of the tremolo bridge relative to said arc, wherein said adjustable locking mechanism is configured for locking the position of the tremolo bridge relative to said arc when the tremolo bridge is not in the default position, said adjustable locking mechanism connected to said first portion of said tremolo arm whereby said tremolo arm is rotatable between an unlocked position in which said tremolo bridge is capable of tilting freely along said arc, and a locked position in which said tremolo bridge is locked and held in its then-current position relative to said arc.

2. The tremolo bridge of claim 1, wherein said adjustable locking mechanism comprises a body plate fixed to said body, and a pressure pin for contacting said body plate, said pressure pin attached to said block, said pressure pin having a length defining a pressure pin axis.

3. The tremolo bridge of claim 2, wherein said block defines a contact surface generally perpendicular to said pressure pin axis.

4. The tremolo bridge of claim 3, wherein said pressure pin can be moved in a first direction along said pressure pin axis towards said contact surface, and wherein said pressure pin can be moved in a second direction along said pressure pin axis away from said contact surface.

5. The tremolo bridge of claim 4, wherein said pressure pin has a first end terminating in a tip, wherein said body plate comprises a locking portion configured for receipt between said tip and said contact surface, wherein in said locked position said locking portion is held via compression between said tip and said contact surface, and wherein in said unlocked position said locking portion is not held via compression between said tip and said contact surface.

6. The tremolo bridge of claim 5, wherein said pressure pin has a first end terminating in an boss, wherein said tremolo arm further comprises a cam member configured for engaging said boss, wherein rotation of said tremolo arm into said locked position causes said cam member to engage said boss and move said pressure pin in said first direction.

7. The tremolo bridge of claim 6, wherein said adjustable locking mechanism further comprises a biasing portion for biasing said pressure pin in said second direction.

8. The tremolo bridge of claim 7, wherein rotation of said tremolo arm into said unlocked position allows said biasing portion to cause the tip to disengage from said locking portion.

9. The tremolo bridge of claim 1, wherein said adjustable locking mechanism comprises a body plate fixed to said body, and a pressure pin for contacting said body plate, said pressure pin attached to said block, said pressure pin having a length defining a pressure pin axis, wherein said block defines a contact surface generally perpendicular to said pressure pin axis, wherein said pressure pin can be moved in a first direction along said pressure pin axis towards said contact surface, and wherein said pressure pin can be moved in a second direction along said pressure pin axis away between said tip and said contact surface, and wherein in said unlocked position said locking portion is not held via compression between said tip and said contact surface, wherein said pressure pin has a first end terminating in an boss, wherein said adjustable locking mechanism further comprises an electro-mechanical actuator configured for engaging said boss, wherein rotation of said tremolo arm into said locked position causes said electro-mechanical actuator to engage said boss and move said pressure pin in said first direction.

10. The tremolo bridge of claim 9, wherein said adjustable locking mechanism further comprises a biasing portion for biasing said pressure pin in said second direction, wherein rotation of said tremolo arm into said unlocked position causes said electro-mechanical actuator to disengage, allowing said biasing portion to cause the tip to disengage from said locking portion.

11. The tremolo bridge of claim 1, wherein said adjustable locking mechanism comprises a brake rod pivotally attached to said block, said brake rod having a length, and a body plate fixed to said body, said body plate comprising a brake portion configured for receiving at least a portion of the length of said brake rod therethrough.

12. The tremolo bridge of claim 11, wherein said brake portion is configured for selectively engaging and disengaging said brake rod.

13. The tremolo bridge of claim 12, wherein said brake portion further comprises an electronic actuator.

14. The tremolo bridge of claim 13, wherein adjustable locking mechanism comprises a sensor, wherein a user of said guitar and utilize the sensor to selectively engage and disengage said brake rod.

15. A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising:

a base plate including at least one pivot point, said at least one pivot point of said base plate engaging said V-shaped notch to allow for tilting movement of the tremolo bridge along an arc;

a block extending from said base plate, said block defining a contact surface generally perpendicular to a pressure pin axis;

a tremolo arm attached to said base plate, said tremolo arm having a first portion and a second portion, said first portion attached to said base plate and said second portion extending angularly from said first portion, said first portion defining a first portion axis along a length thereof, said tremolo arm being rotatable about a swing axis defined generally parallel to said first portion axis and connected to said base plate, said tremolo arm capable of locking said tremolo bridge in a fixed position relative to said body thereby preventing tilting movement of the tremolo bridge;

a tremolo axle, said tremolo having a first and second end, said first end rotatably attached to said first portion of said tremolo arm so that said tremolo arm is rotatable between an unlocked position in which said tremolo bridge is capable of tilting freely and a locked position in which said tremolo bridge is held in a position fixed to said guitar; and a lock mechanism for locking said tremolo bridge in a fixed position relative to said guitar, said locking mechanism comprising a body plate fixed to said body, and a pressure pin for contacting said body plate, said pressure pin attached to said block which is connected to said second end of said tremolo axle, said pressure pin having a length defining said pressure pin axis, said lock mechanism engaging said tremolo bridge when in said locked position by exerting force against said body plate, said body plate thereby exerting force against said tremolo bridge, locking said tremolo bridge, thus fixing said bridge in its then-current position relative to said guitar.

16. The tremolo bridge of claim 15, wherein said pressure pin can be moved in a first direction along said pressure pin axis towards said contact surface, and wherein said pressure pin can be moved in a second direction along said pressure pin axis away from said contact surface.

17. The tremolo bridge of claim 16, wherein said pressure pin has a first end terminating in a tip, wherein said body plate comprises a locking portion configured for receipt between said tip and said contact surface, wherein in said locked position said locking portion is held via compression between said tip and said contact surface, and wherein in said unlocked position said locking portion is not held via compression between said tip and said contact surface.

18. The tremolo bridge of claim 17, wherein said pressure pin has a first end terminating in a boss, wherein said tremolo arm further comprises a cam member configured for engaging said boss, wherein rotation of said tremolo arm into said locked portion causes said cam member to engage said boss and move said pressure pin in said first direction.

19. The tremolo bridge of claim 18, wherein said locking mechanism further comprises a biasing portion for biasing said pressure pin in a second direction wherein rotation of said tremolo arm into said unlocked position allows said biasing portion to cause the tip to disengage from said locking portion.

20. A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising:

a base plate including at least one pivot point, said at least one pivot point of said base plate engaging said V-shaped notch to allow for tilting movement of the tremolo bridge along an arc;

a tremolo arm attached to said base plate, said tremolo arm having a first portion and a second portion, said first portion attached to said base plate and said second portion extending angularly from said first portion, said first portion defining a first portion axis along a length thereof, said tremolo arm being rotatable about a swing axis defined generally parallel to said first portion axis and connected to said base plate;

a sensor for generating a signal, said sensor capable of transmitting said signal, said sensor capable of being placed in a locked position and an unlocked position, said locked position capable of locking said tremolo bridge in its then-current position relative to said arc, said unlocked position capable of allowing said tremolo bridge to tilt freely along said arc;

an electronic actuator for receiving said signal, said actuator operably connected to said sensor, said actuator capable of moving in an engaging direction in response to said signal, said actuator capable of moving in a disengaging direction in response to said signal, said actuator further comprising a biasing portion for biasing said actuator in said disengaging direction, wherein placing said sensor into said unlocked position causes said actuator to disengage, allowing said biasing portion to cause the actuator to disengage from said locked position; and a locking system for locking said tremolo bridge in a fixed position relative to said body, said locking system having a brake rod pivotally attached to said tremolo bridge, a body plate fixed to said body, said body plate comprising a brake portion configured for receiving at least a portion of the length of said brake rod therethrough, said brake operably connected to said actuator, wherein a user of said guitar utilizes said sensor to selectively engage and disengage said locking system, said tremolo bridge locked in its then-current position relative to said arc when engaged and said tremolo bridge capable of tilting freely along said arc when disengaged.

* * * * *